US006209801B1

(12) United States Patent
Kearby et al.

(10) Patent No.: US 6,209,801 B1
(45) Date of Patent: Apr. 3, 2001

(54) CLOSED-CASE IMPACT SPRINKLERS WITH FITTED FLUID SEAL ASSEMBLIES

(75) Inventors: Don Michael Kearby, Breckenridge, TX (US); Joseph U. Han, Irvine, CA (US); Giles A. Kendall, Claremont, CA (US); Derick C. Wright, Pleasanton, CA (US)

(73) Assignee: Virtual Rain, Inc., Breckenridge, TX (US)

( * ) Notice: Subject to any disclaimer, the term of this patent is extended or adjusted under 35 U.S.C. 154(b) by 0 days.

(21) Appl. No.: 09/442,865

(22) Filed: Nov. 18, 1999

Related U.S. Application Data

(63) Continuation-in-part of application No. 09/282,366, filed on Mar. 31, 1999, which is a continuation-in-part of application No. 09/128,269, filed on Aug. 2, 1998.

(51) Int. Cl.[7] ..... B05B 15/10

(52) U.S. Cl. ..... 239/205; 239/200; 239/206; 239/231; 239/232; 239/255

(58) Field of Search ..... 239/201–206, 239/231, 232, 251, 255; 384/303, 304, 420, 424; 411/542, 535, 536

(56) References Cited

U.S. PATENT DOCUMENTS

| | | | | |
|---|---|---|---|---|
| 3,580,506 | * | 5/1971 | Costa | 239/206 |
| 3,580,508 | * | 5/1971 | Azusa et al. | 239/206 |
| 3,602,431 | | 8/1971 | Lockwood | 239/101 |
| 3,625,429 | | 12/1971 | Turrell | 239/206 |
| 3,724,757 | * | 4/1973 | Hunter | 239/205 |
| 3,765,608 | | 10/1973 | Lockwood | 239/230 |
| 3,782,638 | * | 1/1974 | Bumpstead | 239/206 |
| 3,799,631 | | 3/1974 | Martina | 308/36.1 |
| 3,930,617 | | 1/1976 | Dunmire | 239/230 |
| 3,937,494 | | 2/1976 | Hicks | 285/13 |
| 4,055,304 | | 10/1977 | Munson | 239/230 |
| 4,103,828 | | 8/1978 | Ridgway | 239/206 |
| 4,164,324 | | 8/1979 | Bruninga | 239/230 |
| 4,181,259 | * | 1/1980 | Ridgway | 239/206 |
| 4,182,494 | | 1/1980 | Wichman et al. | 239/230 |
| 4,432,495 | | 2/1984 | Bruninga | 239/205 |
| 4,634,052 | | 1/1987 | Grizzle et al. | 239/205 |
| 4,753,391 | | 6/1988 | Rogers | 239/203 |
| 4,773,595 | | 9/1988 | Livne | 239/242 |
| 4,796,809 | | 1/1989 | Hunter | 239/205 |
| 5,098,021 | | 3/1992 | Kah, Jr. | 239/242 |
| 5,765,757 | | 6/1998 | Bendall | 239/205 |

* cited by examiner

*Primary Examiner*—Henry J. Recla
*Assistant Examiner*—Tuan Nguyen
(74) *Attorney, Agent, or Firm*—Wilson Sonsini Goodrich & Rosati

(57) ABSTRACT

A dirt-resistant bearing system for a sprinkler unit with a rotatable turret having a central shaft extending into a support channel formed within an inner housing. The central shaft may be formed with a relatively upper shaft portion and a relatively lower shaft portion, and the support channel may be formed with an upper channel region and a lower channel region. A first bearing and sealing assembly may be fitted substantially around an outer perimeter of the upper shaft portion and in communication with the upper channel region, and a second bearing and sealing assembly may be fitted substantially around an outer perimeter of the lower shaft portion and in communication with the lower channel region. Another aspect of the invention provides a sprinkler head with a fitted serrated seal assembly. The fitted seal assembly may include an outer case having an interior region, and a pop-up sprinkler head turret mounted on a riser sleeve slidably mounted within the interior region of the outer case. The turret may be formed with an elongated central shaft for the passage of water. A water filter may be also provided within the riser sleeve having a valve stem for communication with a lower end portion of the central shaft. The communicating surfaces of the lower end portion of the central shaft and the valve stem of the water filter may be formed with complementary serrated surfaces.

4 Claims, 21 Drawing Sheets

CLOSED-CASE IMPACT SPRINKLERS WITH FITTED FLUID SEAL ASSEMBLIES

This patent application is a continuation-in-part application of pending U.S. patent application Ser. No. 09/282,366 filed on Mar. 31, 1999, which is a continuation-in-part application of pending U.S. patent application Ser. No. 09/128,269 filed on Aug. 2, 1998 which are incorporated by reference in their entirety herein.

FIELD OF THE INVENTION

The present invention is generally directed to irrigation sprinklers. More particularly, the invention relates to closed-case impact sprinkler heads with fitted fluid seal assemblies.

BACKGROUND OF THE INVENTION

Many regions of the world today use irrigation systems for artificial distribution of water. One of the most widely used irrigation systems, particularly where water is not abundant or plentiful, is a sprinkler system wherein one or more sprinkler units are positioned about a land area for distributing water over the surface of the land area. Such systems are widely used in most developed countries for a variety of applications including the irrigation of lawns, golf courses, playing fields and field crops.

Impact sprinklers are generally well known in the art and have been used for many years. There are essentially two broad varieties or types of impact sprinklers. The first type is the open or common riser mounted sprinkler unit which is attached to the end of a riser stem or pipe formed with a water conduit. This type of sprinkler is most often used in open areas such as flower beds or the like which do not require close trimming. These units extend upwardly from the surface and are somewhat obtrusive and unattractive. Consequently, they are used in areas where the units are not readily observed nor require maintenance with lawnmowers. The second type of impact sprinkler is a similar type of unit mounted within a housing which is, in turn, buried beneath the surface of the ground so that the sprinkler generally provides a pop-up unit. These impact sprinklers are most often used in lawn settings, and are mounted within housings or wells that are buried underground. The top of the housings are substantially flush with the ground surface so that open areas such as lawns may be easily landscaped or mowed. When water is supplied to the sprinklers, they pop-up or rise above their housings and the ground surface. In this fashion, the sprinklers remain out of sight until activated. However, the housings for this type of sprinkler, which are designed with an open-case to accommodate standard rotating impact sprinkler arms, tend to become filled with debris such as dirt, grass clippings and the like. Any of the above hamper the ability of the sprinkler to pop-up and to retract, or to effectively drive the sprinkler.

Another common type of irrigation device is known in the art as a gear driven sprinkler. Gear-driven sprinklers have rotating nozzles effectively driven by various gear driving mechanisms which are activated by water supplied to the sprinkler. These sprinklers provide an advantage in that their housings are enclosed by design thus avoiding the problems associated with the open or well-type design of an impact sprinkler. However, it has been observed that gear-driven sprinklers are frequently subject to failure due to debris becoming engaged or lodged within the gear drive mechanism. Many designs are also plagued with a relatively limited watering range due in part to the general power-draining design of the gear driving mechanisms.

The sprinkler literature includes numerous patents relating to variations of sprinkler units known in the art. U.S. Pat. No. 3,602,431 entitled A SPRINKLER DEVICE FOR FLUID DISTRIBUTION (Lockwood) is directed to a sprinkler for distributing water comprising a body, a sprinkler head rotatably connected to the body, a fluid flow interrupter for providing controlled bursts of fluid in the stream of fluid exiting from the sprinkler head, an interrupter drive, a drive means including a free rotating ball for driving the sprinkler head, and reversing means for reversing the direction of movement of the sprinkler head. U.S. Pat. No. 3,765,608 entitled AUTOMATIC INTERMITTENT BREAK-UP DEVICE (Lockwood) is directed to a sprinkler with an automatic intermittent break-up device repeatedly movable toward the center of the fluid stream exiting a nozzle to a first position to increase the break-up of the stream and movable away from the center of the fluid stream exiting the nozzle to a second position to decrease the break-up to provide more desired distribution of fluid on the surface area. U.S. Pat. No. 3,930,617 entitled IMPACT SPRINKLER (Dunmire) is directed to an impact sprinkler which uses a plastic water deflector having a number of cooperating water deflecting surfaces which improve the overall water distribution pattern of the sprinkler; the particular configuration provided for allowing the water deflector to pivot back and forth. U.S. Pat. No. 4,055,304 entitled AUXILIARY BRAKING MEANS FOR IMPACT ARM SPRINKLERS (Munson) is directed to an impact type rotary sprinkler including a rotatable body and nozzle, an impact arm which oscillates responsive to the kinetic energy of the fluid discharge stream and a primary spring which stores the rotational energy of the oscillating arm rotating to impact against the housing and impart an increment of rotation thereto. U.S. Pat. No. 4,103,828 entitled ROTARY SPRINKLER IMPACT ARM SPRING ADJUSTMENT (Ridgway) is directed to a rotary sprinkler with structure for adjusting the force applied to the impact arm by the impact arm spring, viz. a laterally directed nozzle cooperating with the arm to rotate the nozzle and an impact arm on a shaft extending above the nozzle. The arm is mounted within a cage extending above the nozzle. U.S. Pat. No. 4,164,324 entitled SPRINKLER HEAD WITH IMPROVED INTEGRAL IMPACT ARM AND ANTI-BACKSPLASH DRIVE SPOON (Bruninga) is directed to a part-circle rotary sprinkler head having an improved anti-backsplash drive spoon integrally formed as a part of the impact arm. U.S. Pat. No. 4,182,494 entitled ANTISIDE SPLASH DRIVE ARM FOR AN IMPACT DRIVE SPRINKLER (Wichman) is directed to an impact sprinkler of the full or part circle type with an anti side splash drive arm. Despite these and other known sprinkler designs, there is a need for an irrigation sprinkler that incorporates the advantages provided by both impact and gear-driven sprinkler designs.

SUMMARY OF THE INVENTION

The invention provides closed-case impact sprinkler units. The particular features of the described embodiments in the following specification may be considered individually or in combination with other variations and aspects of the invention.

It is an object of the present invention to provide impact sprinkler assemblies with a closed-case design. A sprinkler unit formed in accordance with the invention may include an inner housing and an outer housing which are slidably mounted relative to each other. The unit may have a central shaft slidably mounted within the inner housing, and the upper end of the central shaft may include an outlet nozzle mounted in a turret. The sprinkler units provided herein also have filters for filtering water flowing through the units, and may have an inner valve means in a main through-passage for impeding the flow of water through the sprinkler unit until they are placed in a pop-up position or when the impact arm is clear of the outer body housing. Upon retraction, the inner valve means stops the flow of water thereby allowing the arm to move back into the turret before the inner housing lowers back into the outer housing. The sprinkler units provided herein enable uniform speed of rotation of the turret with different nozzles and flow rates, and provide relatively easy installation and removal for service.

Another embodiment of the invention includes a sprinkler unit with delayed activation. The unit may have an outer case formed with a fluid inlet that is in fluid communication with an interior region of the outer case. A rotatable closed-case turret assembly may be formed with a fluid outlet that is in communication with a central shaft having a lower end shaft portion extending into the interior region of the outer case. An extendable riser sleeve supporting the rotatable turret assembly may be slidably positioned within at least a portion of the interior region of the outer case. The riser sleeve includes a filter with at least one spring retainer extending through a slot formed along a sidewall portion of the riser sleeve, and a valve seat formed along a top portion of the filter that may selectively disengage from the lower end shaft portion of the central shaft to permit the flow of fluid from the interior region of the case into the central shaft. A delayed riser spring assembly may be further included having a first riser spring positioned between the spring retainer and a lower end portion of the riser sleeve, and a second riser spring positioned between the spring retainer and the upper end portion of the outer case. The first riser spring may be compressed when a fluid enters the interior region of the outer casing to move the riser sleeve in a relatively upward direction. The second riser spring may be compressed upon compression of the first riser spring to disengage the valve seat from the lower end shaft portion of the central shaft to permit the flow of fluid from within the interior region of the outer casing out through the fluid outlet. Additionally, the closed-case turret assembly may include an impact sprinkler assembly having an extendable impact arm. The impact arm, turret assembly and riser sleeve may combine to form a substantially continuous cylinder positioned within the interior region of the outer case.

It is a farther object of the invention to provide a closed-case impact sprinkler unit. An outer case may house a riser sleeve within the interior region of the outer case that is upwardly extendable from the outer case into a pop-up position. The riser sleeve may be formed with an external surface that is complimentary to the internal surface of the outer case to prevent the introduction of debris into the interior region of the outer case when the riser sleeve is in a pop-up position. In addition, a closed-case turret assembly may be rotatably positioned on the top end portion of the riser sleeve. The turret assembly may include a fluid outlet passageway in communication with the fluid inlet, and a hinged impact arm mounted within the turret assembly that interacts with water ejected from the fluid outlet passageway. Another variation of the sprinkler unit may include a hinged impact arm extendable beyond the turret assembly into an open position when impacted by a fluid that is ejected from the fluid outlet passageway. The unit may further include means for selectively permitting the flow of fluid into the fluid outlet passageway to extend the impact arm into an open position only when the riser sleeve is placed in a pop-up position.

A dual-stage sprinkler head is further provided in accordance with the concepts of the invention. The sprinkler head may include an outer sleeve having an interior chamber and a fluid inlet, and an inner sleeve having a fluid outlet that is slidably positioned in at least a portion of the interior chamber of the outer sleeve. The inner sleeve may include a slidably connected spring retainer connected to a valve assembly that selectively permits the passage of a fluid from the fluid inlet to the fluid outlet when moved relatively downward with respect to the inner sleeve. In addition, the sprinkler head may include a riser spring assembly having a first spring positioned between the spring retainer and a lower end portion of the inner sleeve, and a second spring positioned between the spring retainer and an upper end portion of the outer sleeve. The first spring may be compressed during a first stage as the inner sleeve rises when fluid enters from the fluid inlet into the interior chamber of the outer sleeve, and the second spring may be compressed during a second stage as the first spring moves towards a compressed state to move the spring retainer relatively downward with respect to the inner sleeve to permit the passage of fluid through the sprinkler unit. In addition, a turret may be rotatably mounted the top portion of the inner sleeve, and an impact arm may be rotatably mounted to the turret. The impact arm may selectively extend to an open position only during the second stage when the valve assembly permits the passage of fluid to the fluid outlet. Furthermore, the impact arm may be rotatably mounted to the turret with an off-centered hinge pin. An nozzle may direct fluid towards the impact arm wherein the nozzle includes a fluid vane positioned within its interior region to direct fluid flow out of the nozzle.

Another aspect of the invention provides an impact sprinkler head with extended sprinkling range. The sprinkler head may include an outer sleeve formed with an end opening and an internal surface having a fixed trip, and a trip collar rotatably mounted to the end opening of the outer sleeve, wherein the trip collar includes an adjustable trip. An impact sprinkler head and turret assembly may be rotatably connected to the trip collar having a trip assembly for reversing direction of the impact sprinkler head and turret assembly. The trip assembly may further include an elongated actuator opening, and a trip pin pivotally mounted within the actuator opening to provide lateral movement of the trip pin within the actuator opening to initiate a delayed reversal of the trip assembly upon contact with either the fixed or adjustable trip to provide an extended sprinkling range. It is a further object of the invention to provide a reversible drive sprinkler unit with a rotary drive that is a significant improvement over the well-known impact arm concept, and can drive the sprinkler through a desired arc of coverage. The sprinkler arc may be a full circle or a reversible partial circle with the arc of coverage being adjustable with control mechanisms provided herein.

With respect to yet another aspect of the invention, closed-case sprinkler units are provided herein with fitted fluid seal assemblies. Various fluid seal assemblies described herein may reduce the entry of grit and dirt into the water-stream within the unit. An embodiment of the invention provides a dirt resistant bearing system for a sprinkler unit with a rotatable turret having a central shaft extending into a support channel formed within an inner housing. The central shaft may be formed with a relatively upper shaft portion and a relatively lower shaft portion, and the support channel may be formed with an upper channel region and a lower channel region. A first bearing and sealing assembly may be fitted substantially around an outer perimeter of the upper shaft portion and in communication with the upper channel region, and a second bearing and sealing assembly may be fitted substantially around an outer perimeter of the lower shaft portion and in communication with the lower channel region. These bearing and sealing assemblies may include various combinations of sealing and bearing washers that promote a fluid seal between movable components within the sprinkler unit such as a support channel and a central turret shaft. The outer and inner diameter regions of the assemblies may be thus sealed under a water and/or spring load while supporting the rotatable turret shaft.

In yet another aspect of the invention, a sprinkler head is provided with a fitted serrated seal assembly. The fitted seal assembly may include an outer case having an interior region, and a pop-up sprinkler head turret mounted on a riser sleeve slidably mounted within the interior region of the outer case. The turret may be formed with an elongated central shaft for the passage of water. A water filter may be positioned within the riser sleeve having a valve stem for communication with a lower end portion of the central shaft. The communicating surfaces of the lower end portion of the central shaft and the valve stem of the water filter may be formed with complementary serrated surfaces. Additionally, the lower end portion of the shaft may be defined by or include a removable inlet nut with matching serrations within the inner perimeter of the nut portion for contact with a complementary surface surrounding an exterior portion of the water filter valve stem.

Other objects and advantages of the invention will become apparent upon further consideration of the specification and drawings. While the following description may contain many specific details describing particular embodiments of the invention, this should not be construed as limitations to the scope of the invention, but rather as an exemplification of preferable embodiments. For each aspect of the invention, many variations are possible as suggested herein that are known to those of ordinary skill in the art.

DETAILED DESCRIPTION OF THE INVENTION

Figure 1:
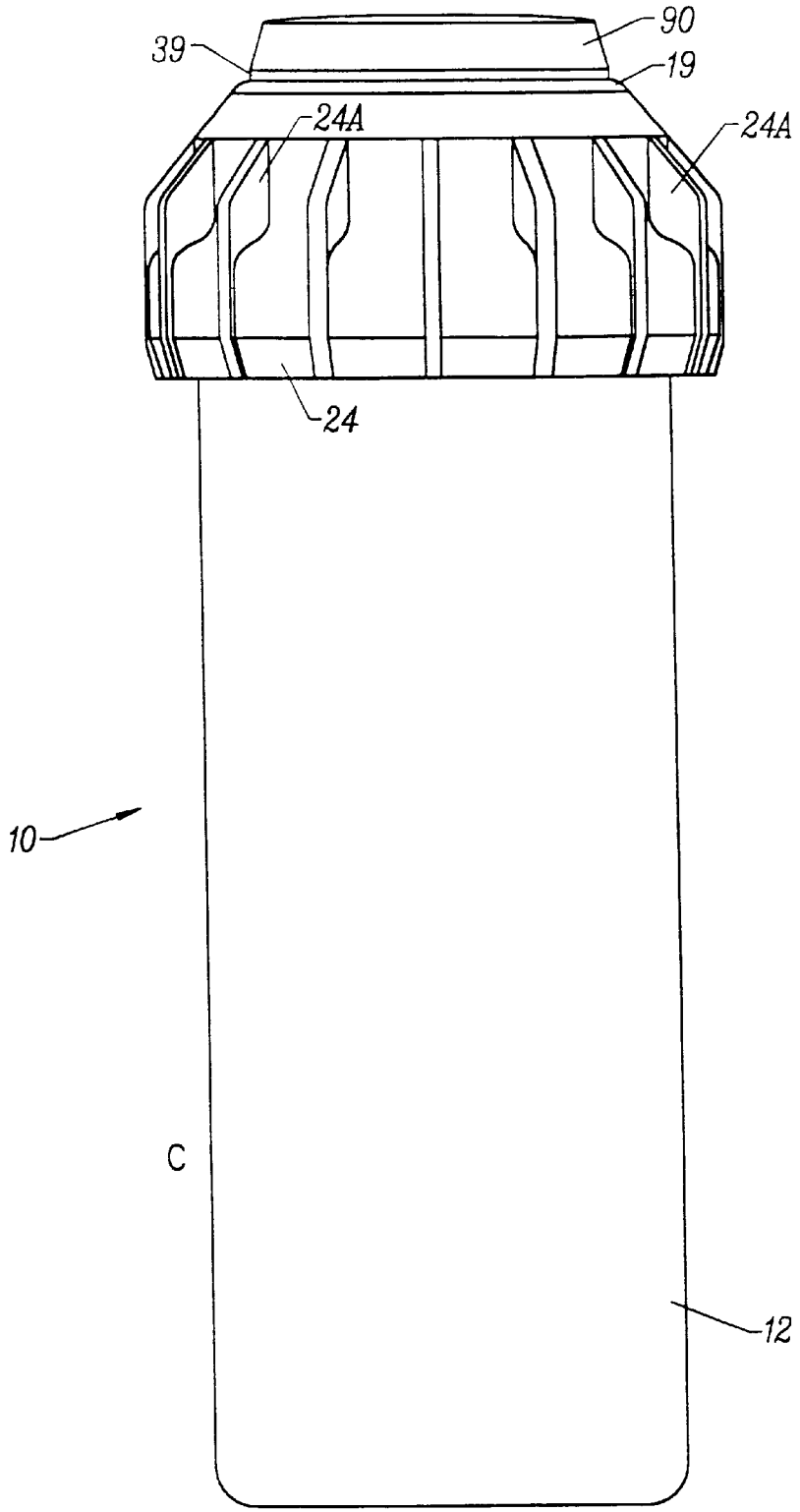
FIG. 1 is an external view of a closed-case impact sprinkler unit formed in accordance with the invention that is shown in a retracted or closed position.

Referring now to FIG. 1, there is shown an external view of a closed-case sprinkler unit 10 formed in accordance with the invention. The illustrated sprinkler unit 10 is in a closed or retracted position, and is at rest (quiescent) or non-operational in this condition. The sprinkler unit 10 generally includes an outer housing 12 that may be formed with a generally cylindrical shape or any other suitable configuration. The housing 12 is typically fabricated of ABS plastic or the like. A threaded retaining cap or cover 24 may be also attached to the top portion of the outer housing 12, and may be formed with a plurality of flanges 24A or similar gripping structures to facilitate handling of the cap when it is engaged to, or disengaged from, the outer housing. Additionally, the top portion of the sprinkler head unit 10 may include an optional protective cap cover 90 attached to a turret cover 39 that rests on top of an inner mounted turret positioned within the outer housing 12. A wiper seal 19 may be retained within the unit 10 in between the retaining cap 24 and the turret cover 39 when the sprinkler head remains in a retracted position. The wiper seal 19 may substantially surround the slidably mounted turret within the outer housing 12.

Figure 2:
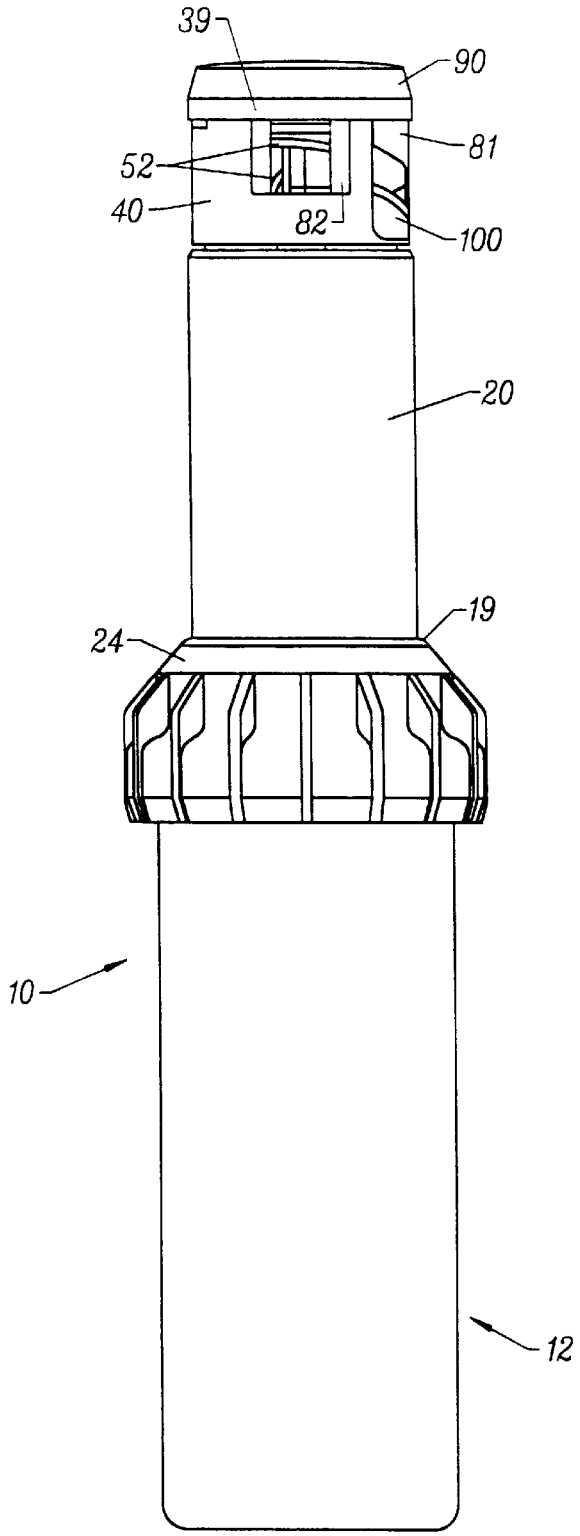
FIG. 2 is an external view of the sprinkler unit shown in FIG. 1 having an extended or open position.

FIG. 2 provides an external view of the sprinkler unit 10 in an open or extended position. In this operating or pop-up position, a turret 40 is extended above the cap 24, and the unit 10 is in a condition to spray water therefrom. The top portion of the turret 40 may be enclosed with the turret cover 39 which may, in turn, include the adjacent cap cover 90. The top sidewall portion of the turret 40 may be formed with a nozzle opening 82. Water may be ejected through the nozzle opening 82 from a nozzle 52 enclosed within the turret 40. The sidewall of the turret 40 may further include a shield opening 81 through which an impact arm 100 extends when the unit 10 is operational or in a pop-up position. Additionally, an inner housing or riser sleeve 20 may be snugly, but slidably, surrounded by the wiper seal 19. The inner housing 20 may be pushed in a relatively upward direction out of the outer housing 12 by the application of pressurized water or the like. Upon removal of the water source, the inner housing 20 may slidably move downward and return to a retracted position into the interior of the outer housing 12. An inlet or opening (not shown) may be formed at the lower end of the outer sprinkler housing 12 to receive pressurized water from a source such as a network of underground pipes. Additionally, closed-case sprinkler units described herein may provide delayed activation. A unit may include an outer case formed with a fluid inlet that is in fluid communication with an interior region of the outer case. A rotatable closed-case turret assembly may be selected that is formed with a fluid outlet in communication with a central shaft having a lower end shaft portion that extends into the interior region of the outer case. An extendable riser sleeve, which supports the rotatable turret assembly, may be slidably positioned within the interior region of the outer case. Furthermore, the riser sleeve may include a filter with one or more spring retainers extending through a slot formed along a sidewall portion of the riser sleeve. A valve seat may be also formed along a top portion of the filter that may selectively disengage from the lower end shaft portion of the central shaft to permit the flow of fluid from the interior region of the case into the central shaft. In addition, a delayed riser spring assembly having a first riser spring may be positioned between the spring retainer and a lower end portion of the riser sleeve, and a second riser spring may be positioned between the spring retainer and the upper end portion of the outer case. The first riser spring may be compressed when a fluid enters the interior region of the outer casing to move the riser sleeve in a relatively upward direction, and the second riser spring may be subsequently compressed upon compression of the first riser spring to disengage the valve seat from the lower end shaft portion of the central shaft to permit the flow of fluid from within the interior region of the outer casing out through the fluid outlet. The closed-case turret assembly may also include an impact sprinkler assembly that is driven by fluid exiting the fluid outlet. Moreover, the impact sprinkler assembly may include an impact arm that is extendable beyond an external surface of the turret assembly when fluid exits the fluid outlet. The impact arm can be formed with an external surface that is complementary to an adjacent external surface of the turret assembly. The riser sleeve may be formed with an external surface so that the external surfaces of the impact arm, turret assembly and riser sleeve combine form a substantially continuous cylinder that may positioned within the interior region of the outer case.

Figure 3A:
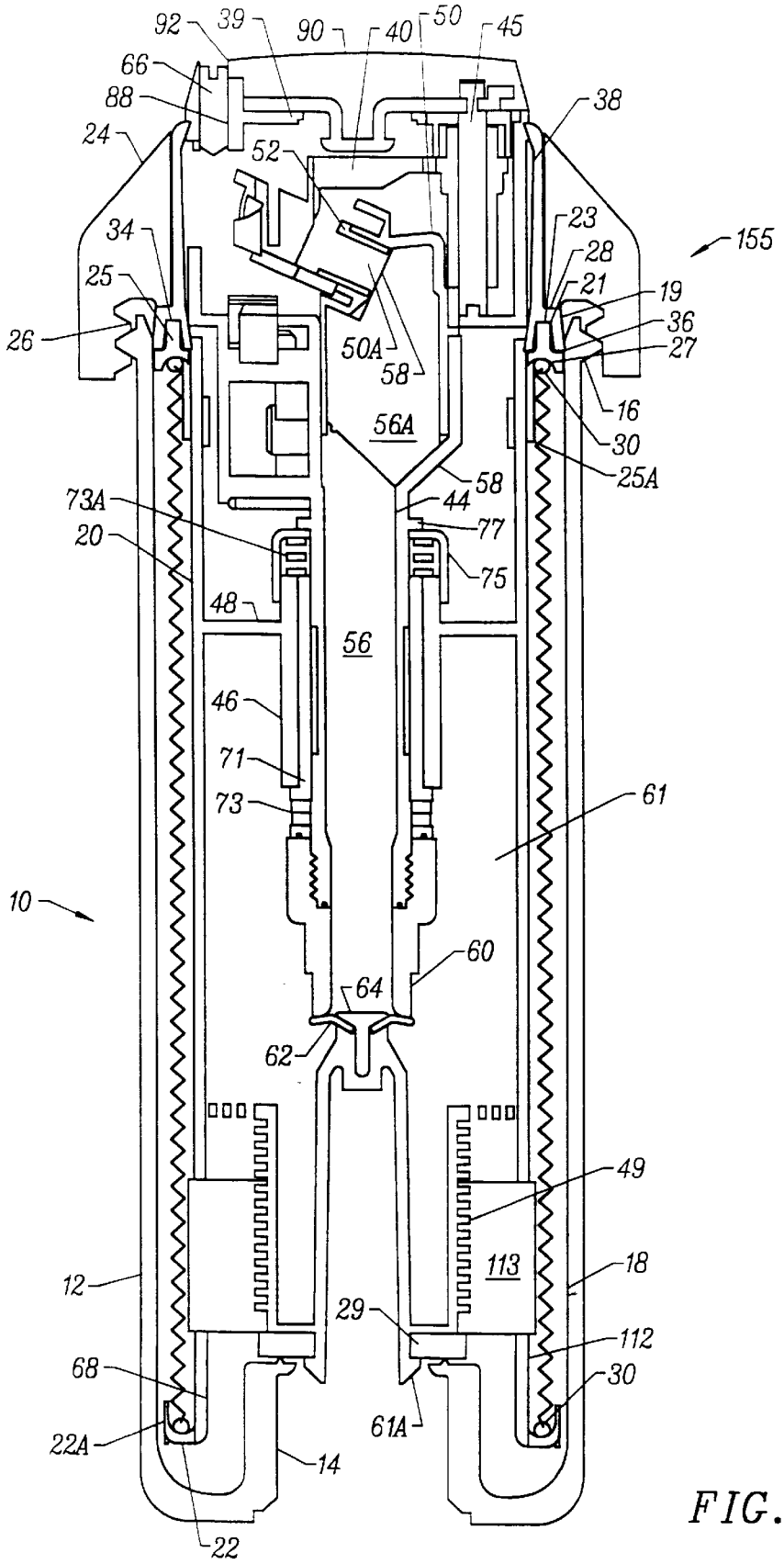
FIG. 3A is a detailed cross-sectional view of a closed-case impact sprinkler unit in a substantially retracted position.

FIG. 3A provides a relatively detailed cross-sectional diagram of a closed-case sprinkler head unit 10 formed in accordance with the invention. The sprinkler unit 10 may comprise an outer housing 12 having an inlet 14 formed at its lower end which may be threaded. The sprinkler head unit 10 may be thus threadably mounted to a riser or other suitable connection to a source of pressurized water (not shown). In addition, the outer housing 12 has an upper end that may include external threads for engagement or cooperation with internal threads formed on the interior of a retaining cap 24. The retaining cap 24 may generally assist in retaining an axially extendable or extensible inner housing 20 within the interior or bore of the outer housing 12. The cap 24 may further include an interior annular shoulder 28 that captures and retains a wiper seal 19 mounted within the central opening of the cap. The wiper seal 19 may be formed with a central bore 38 through which the inner housing or riser sleeve 20 selectively extends and retracts. Also, the wiper seal 19 may include a seat 34 in the form of an annular rim formed on the outer surface of the seal 19. The seat 34 may be captured by or positioned relatively underneath the internal shoulder 28 of the retaining cap 24. The seal 19 also includes an inner lip 36 adjacent to or relatively inward from the seat 34 which slidably engages the outer surface of the inner housing 20. The lip 36 may provide a seal against water leakage around the inner housing 20. Moreover, the seat 34 includes an annular groove 21 formed around its lower end or interior portion. The annular groove 21 retains an adjoining spring support lip 23 that projects upwardly from a spring retainer 25. The lower surface of the spring retainer 25 may further include an annular groove or channel 27 to capture and retain the upper end of an elongated compression or riser spring 30. As explained in more detail below, the riser spring 30 may be compressed when the inner housing 20 is moved relatively upward within the outer housing 12 when water is applied or introduced into the sprinkler unit 10. The spring 30 may be thus positioned between the upper portion of a radially extending flange 22 formed at the lower end of the inner housing 20, and the annular groove 27 formed along the bottom portion of the spring retainer 25 located near the upper end of the inner housing. The flange 22 may include one or more grooves 22A along its periphery that slidably engage the ribs 18. As a result, the inner housing 20 may be slidably, but not rotatably, mounted within the outer housing 12 in a relatively upward and downward direction. It is understood that the ribs and grooves may be reversed as to their respective locations along the inner housing 20 and the outer housings 12. Additionally, the spring retainer 25 may include an elongated support leg 25A that extends downwardly therefrom for slidable engagement with the outer surface of the inner housing or riser sleeve 20. As a result, the spring retainer 25 and its elongated leg 25A may also function as a guide for upward and downward movement of the inner housing 20. The lower end of the elongated leg 25A further operates as an upper limit stop that engages the section of a guide 113 surrounding at least a portion of a filter 49 that moves upwards and downwards with the lower end portion of the inner housing 20. One or more ribs 18 may be formed on the inner surface of the outer housing 12 to aid in guiding and orienting the inner housing 20 within the outer housing.

A rotatable turret assembly may be further positioned within the inner housing 20. The assembly may include a turret 40 mounted on a partially conical member 58 at the upper end of an elongated, central hollow shaft 44. The shaft 44 may be rotatably mounted in a support channel 46 joined to the inner surface of inner housing 20 by an annular shoulder 48. As will be described hereinafter, the shoulder 48 participates in the upward movement of the inner housing 20 when water or other fluid applies pressure thereto. The turret 40 in the illustrated embodiment may be covered by a circular cap 39 which has an aperture or cap opening 88 through which a radius adjusting screw 66 extends. A protective cover 90, typically formed of hard rubber, santoprene or the like, may be mounted over the cap 39 and include a cover opening 92 for access to the radius adjusting screw 66 as illustrated. A toolcoupling slot 80 may be formed in the upper end of the adjusting screw 66. The slot 80 may be configured as a screwdriver slot or a hex key-like slot for receiving a tool that rotates the radius adjusting screw 66.

Additionally, a pressed-on bearing 71 may be mounted around the midportion of the central shaft 44. The bearing 71 assists the central shaft 44 in rotating smoothly and easily within the cylindrical support channel 46. An inlet cap 60 may be threadedly attached to the lower end of the central shaft 44. Furthermore, a bearing stack 73 may be disposed around the shaft 44 intermediate the inlet cap 60 and the bearing 71. The bearing stack 73 typically includes a plurality of separate annular bearings or washer-like components that may be formed with different hardness and frictional characteristics in order to facilitate rotation of the central shaft 44 without binding or undesired interference. A spring 73A applies a load between the support channel 46 and a thrust load bearing 75 whereby the inlet cap 60 may be continuously vertically loaded. The thrust load bearing 75 may be generally cup-shaped and formed with a hole therethrough to accommodate the shaft 44. An annular shoulder 77 formed along a portion of the shaft 44 may rest upon the bearing 75. The edges of the bearing 75 may slidably and rotatably engage the upper end of the support channel 46 to restrict the flow of debris into the upper portion of the bearing 71.

Furthermore, a filter 49 may be connected to a relatively lower end of the inner housing or riser sleeve 20, and may be slidably movable therewith. The filter 49 may be generally configured as a basket that readily passes water therethrough while capturing particulate matter such as, but not limited to, sand, grass and the like. The entry of debris into the internal components of the unit is thus minimized that would otherwise cause blockage. The filter 49 typically includes at least one guide 113 formed along at least a portion of the side thereof to engage a groove 112 formed along the lower end surface of inner housing 20 in order to prevent rotation of the filter 49 relative to the inner housing, and to further control the relative movement of the filter within the outer housing 12. The filter 49 may be thus slidably, but not rotatably, mounted to the inner housing 20 to move in a relatively upward or downward direction. The filter 49 may further include a valve stem 61 that extends vertically through the center thereof. A conically shaped valve seat 62 may be formed of deformable material such as hard rubber of the like, and may be attached to the relatively upper end of the valve stem 61 by a seal retainer 64. The seal retainer 64 may be threadedly attached or friction fitted to the valve stem 61. It will be seen that the valve seat 62 cooperates with the inlet cap 60 to prevent or restrict water passage until relatively upward movement of the filter 49 is stopped by the elongated support leg 25A whereupon the internal valve assembly opens and the inlet cap 60 is disengaged from the valve seat to permit water to flow therethrough. When the leg 25A or limit stop restricts the upward movement of the filter or screen 49, the central shaft 44 may continue to move relatively upwardly along with the inner housing 20.

A check valve may be formed between the filter 49 and the lower end portion of the outer housing 12 that consist of a suitable washer or gasket 29 positioned along the under side of the filter. The gasket 29 may be maintained in a relatively fixed position or place by a plurality of fingers 61A which extend from the lower end of the valve stem 61 and below the lower surface of filter 49. Accordingly, the overall sprinkler head unit generally forms a flow passage between the inlet 14 and an outlet 50A formed in the detachably mounted nozzle assembly 50. The check valve provided at the lower end of the inner housing 20 operates to selectively open and permit the flow of water through the filter 49, and subsequently through a bore 56 formed within the central shaft 44 and the outward portion 58 extending relatively upward and outward at an angle near the turret 40. The gasket 29 may further prevent fluid backflow into the inlet passageway 14. When pressurized water is no longer supplied to the sprinkler unit, the inlet cap 60 moves toward a closed position with respect to the valve seat 62, and the valve gasket 29 may be situated in a relatively closed position. In this condition, the sprinkler unit 10 may be fully closed wherein the valve assemblies sequentially close off the passage and potential flow of water through the unit.

Figure 3B:
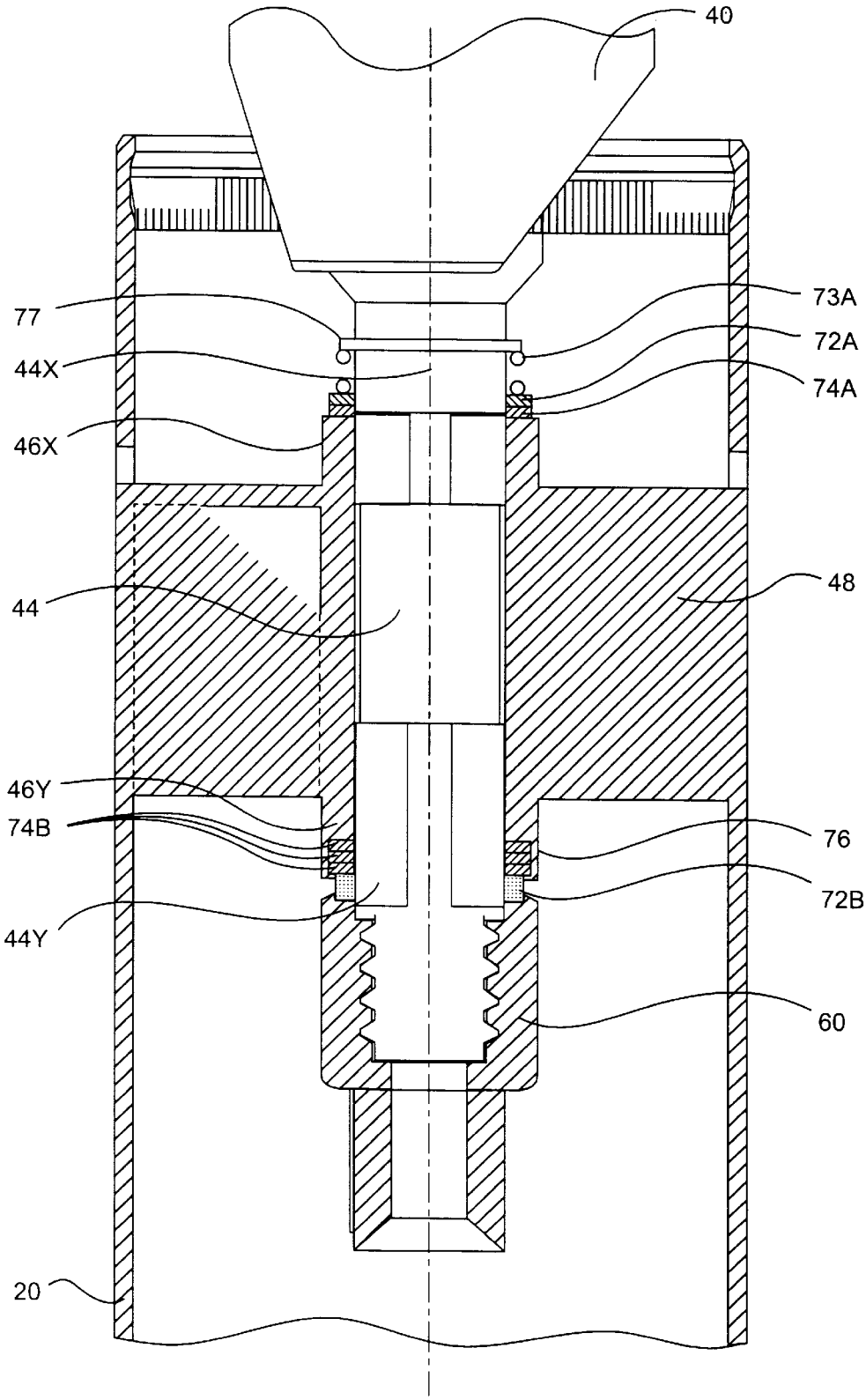
FIG. 3B is a detailed cross-sectional view of a sprinkler unit with a washer and bearing assembly formed in accordance with an aspect of the invention.

FIG. 3B provides a cross-sectional view of a washer and bearing assembly for a sprinkler unit that is formed in accordance with another aspect of the invention. This grit or dirt resistant bearing system may include a rotatable turret 40 having a central shaft 44 extending into a support channel 46 formed within an inner housing or riser sleeve 20. The central shaft 44 may be formed with a relatively upper shaft portion 44X and a relatively lower shaft portion 44Y. Moreover, the support channel 46 may be also formed with an upper channel region 46X and a lower channel region 46Y. The support channel 46 may be formed with a generally cylindrical configuration, and may be supported or mounted by a shoulder 48 within the inner housing 20. Additionally, a first bearing and sealing assembly may be fitted substantially around an outer perimeter of the upper shaft portion 44X and in communication with the upper channel region 46X. A second bearing and sealing assembly may be also fitted substantially around an outer perimeter of the lower shaft portion 44Y and in communication with the lower channel region 46Y.

The first and second bearing and sealing assemblies may be formed between the central shaft 44 and the support channel 46 to provide a fluid seal while permitting rotatable movement. Each of the bearing and sealing assemblies may have any combination of one or more bearing or sealing washers. The central shaft 44 may be formed with a relatively upper shaft portion 44X that includes an annular shoulder 77. The first bearing and sealing assembly may be positioned in between the annular 77 shoulder and the upper channel region 46X. The first assembly may include a load spring 73A, a sealing washer 72A, and a bearing washer 74A. It may further include a cup-shaped thrust load bearing (not shown) as described above for housing at least a portion of the sealing washer 72A and bearing washer 74A. In a preferable embodiment, the bearing washer 74A is positioned adjacent to the upper channel region 46X to provide relatively low friction rotational movement of the central shaft 44 relative to the support channel 46. At the same time, an inlet nut 60 may be selected wherein the second bearing and sealing assembly is positioned in between the inlet nut and the lower channel region 46Y. The second bearing and sealing assembly may include a sand/grit shroud 76, a sealing washer 72B, and one or more bearing washers 74B. The bearing washer 74B may be also positioned adjacent to the lower channel region 46Y. Sealing washers are preferably formed of a deformable material such as rubber or plastic to promote a water resistant seal. The first and the second bearing and sealing assemblies, and the components therein, may each include an aperture formed therethrough to permit passage of the central shaft.

In another embodiment of the invention, in combination with other aspects and combinations of the invention described herein, a closed-case impact sprinkler unit may be provided with a bearing/sealing washer system. The unit may be formed with an outer case having an interior region, and a riser sleeve formed with a top end portion and an internal support channel. The riser sleeve may be slidably positioned within the interior region of the outer case, and may be upwardly extendable into a pop-up position. A closed-case turret assembly for the passage of water may be rotatably positioned on the top end portion of the riser sleeve. The turret assembly may include a central shaft passing through the support channel of the riser sleeve. Additionally, a bearing and sealing washer system may be fitted around the central shaft in proximity to the support channel to provide rotatable movement and a dirt-resistant fit between the support channel and the central shaft.

The bearing and sealing washer system may include a first and a second washer assembly. Each assembly may provide a dust seal to prevent or minimize the entry of particulate or dirt into the waterstream within the central shaft. The support channel within the riser sleeve may include a relatively upper region and a relatively lower region, wherein the first washer assembly is positioned substantially adjacent to the upper region of the support channel, and the second washer assembly is positioned substantially adjacent to the lower region of the support channel. The bearing and sealing washer system may include at least one bearing washer and at least one sealing washer. A low-friction bearing washer may carry both radial and normal loads. The bearing washer may be preferably formed of a relatively low friction material such as Teflon, and the sealing washer may be formed of rubber. With respect to the first or top bearing and sealing washer assembly, a spring may be included within a shroud or thrust load bearing to urge the sealing washer in an interference fit with the shaft, and in constant sealing contact with a Teflon or low-friction bearing washer positioned below. With respect to the second or bottom bearing and sealing washer assembly, a sand/grit shroud may substantially house the bearing and sealing washers. The shroud may be an additional separate component or integrally formed with the support channel. A bearing washer may be positioned below the support channel to support relative movement of the shaft under load, and may be located above a sealing washer. A rubber sealing washer may be selected with an inner diameter that forms a seal with the central shaft to deter grit entry. Furthermore, an inlet nut may be secured to the central shaft with complementary threaded portions to secure the bearing and sealing washer assemblies to form an interference fit that minimizes the passage of dirt or obstructions into the fluid passageway within the central shaft. Under the resulting water pressure and spring load provided by this fitted fluid seal, the inner and the outer diameter portions of the washer assemblies may be effectively fluid sealed at either end of the support channel while permitting free rotational movement of the sprinkler turret assembly.

Figure 4:
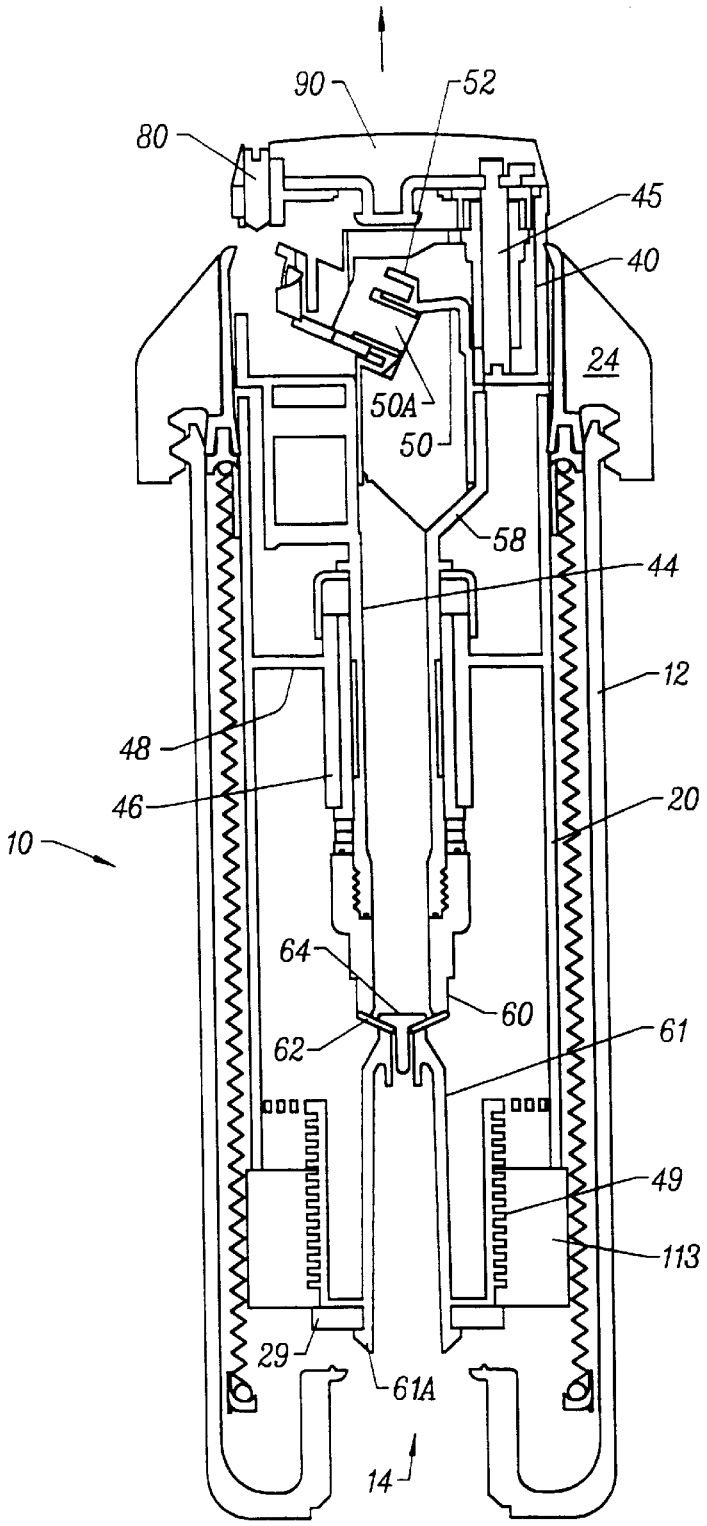
FIG. 4 is a relatively simplified cross-sectional view of a unit similarly shown in FIG. 3A in a slightly open or extended position.
Figure 5:
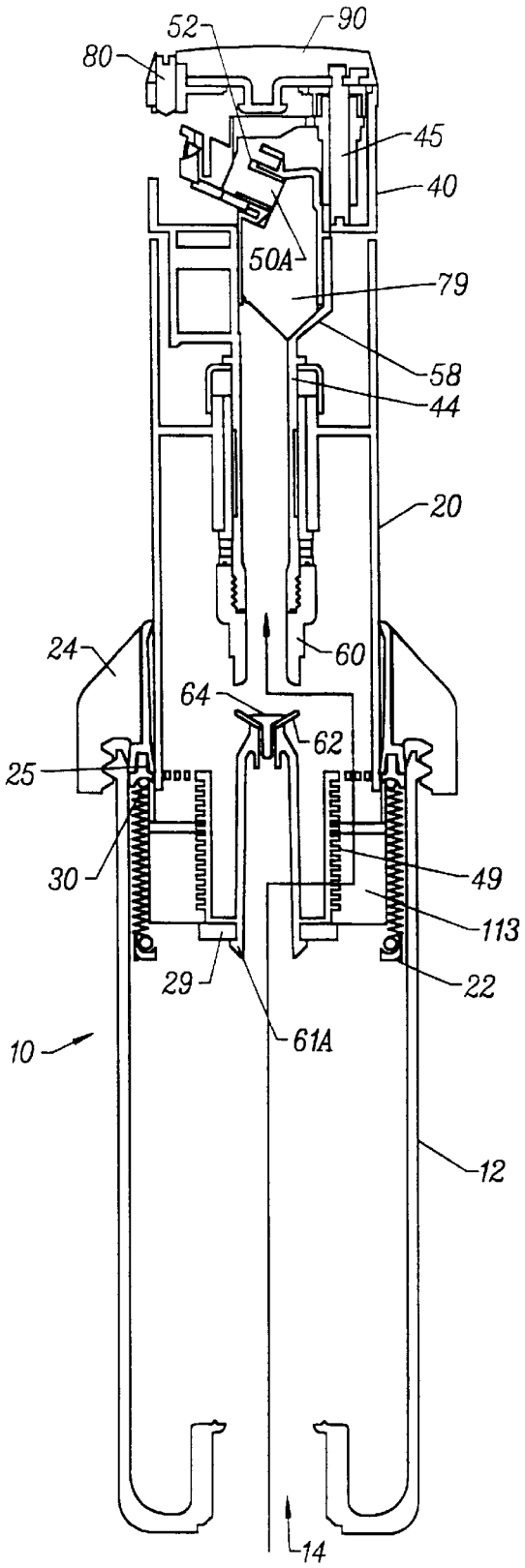
FIG. 5 is a relatively simplified cross-sectional view of the unit shown in FIG. 4 in a substantially open or extended position.

FIGS. 4–5 illustrate a sprinkler unit 10 provided in accordance with the invention that is shown in relatively simplified cross-sectional view. After pressurized water is supplied through an inlet 14, as shown in FIG. 4, a relatively non-rotating inner housing 20, together with a filter 49, is upwardly movable within an outer housing 12. A turret 40 similarly moves with the inner housing 20 upwardly and out of the outer housing 12. However, an internal shut-off valve seat 62 momentarily remains in a relatively closed position so water does not flow through an internal conduit within the central shaft 44. This valve assembly remains closed inasmuch as the water pressure on the shoulder 48 of an adjoining support channel 46 containing the central shaft 44 is substantially the same as on the interior of a valve stem 61 within the filter 49. The inner housing 20 and the filter 49 thus move upwardly together. The central hollow shaft 44 is also moved upwardly while the valve seat 62 and an inlet cap 60 remain in sealing contact to delay the flow of water. Water flow through the sprinkler 10 and the valve seat 62 is prevented or delayed until the turret 40 and the impact arm located therein have extended beyond and cleared out of the outer housing 12. This prevents premature and inadvertent opening of the impact arm which may lead to unit malfunction. When the water flow is removed, the flow of water towards the turret 40 is cut-off so as to permit retraction of the impact arm before the inner housing 20 returns to the interior portion of the outer housing 12.

Referring now to FIG. 5, the sprinkler unit 10 is illustrated in a substantially extended or pop-up position after pressurized water is introduced through the inlet 14. The force of incoming water forces the inner housing 20 to extend relatively upward and out of the outer housing 12. When the water pressure increases to the point where a guide surface 113 of the filter 49 contacts the limit stop surface 25A of retainer the 25, the internal valve assembly may be opened in order to allow water to flow freely into the central shaft 44 towards a nozzle 52. Meanwhile, the riser spring 30 may be thus compressed between spring latches such as a flange 22 and a spring retainer 25. The inner housing 20 therefore remains biased to move downwardly and back into outer housing 12 when water pressure is removed and the flow turned off by an operator to stop water from entering into the sprinkler unit 10. In a substantially extended position, the water flow pathway through the unit 10 begins at the inlet 14, through the filter 49, through the opened internal shut-off valve assembly, through the central shaft 44, and through its adjoining offset channel 58 which may further include a vane 79 to reduce turbulence of water that eventually passes and exits through the nozzle 52.

Figure 6A:
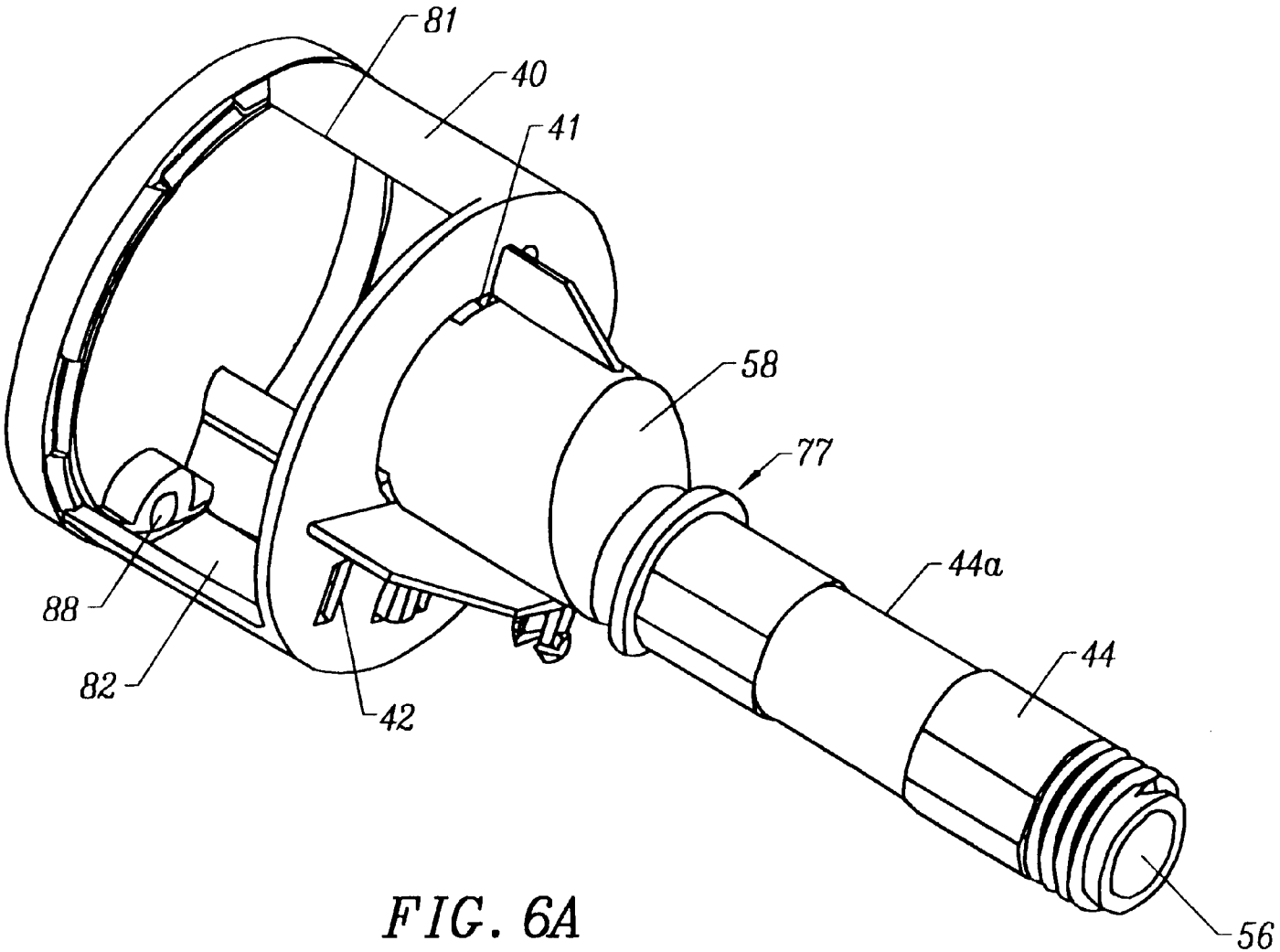
FIGS. 6A–C are perspective views of an inner shaft and turret assembly that is configured for placement within the interior portion of an inner sprinkler housing or riser sleeve.
Figure 6B:
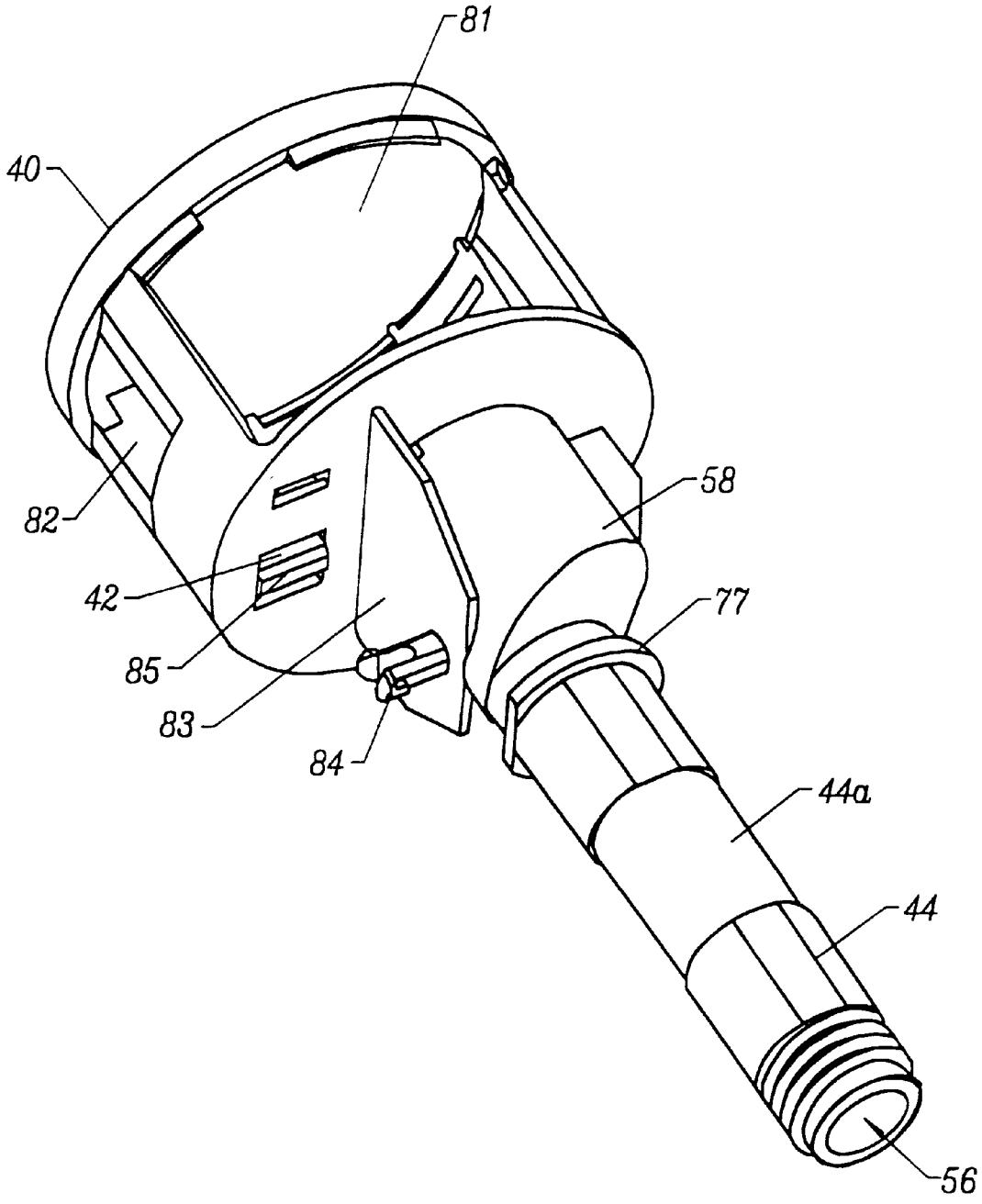
Figure 6C:
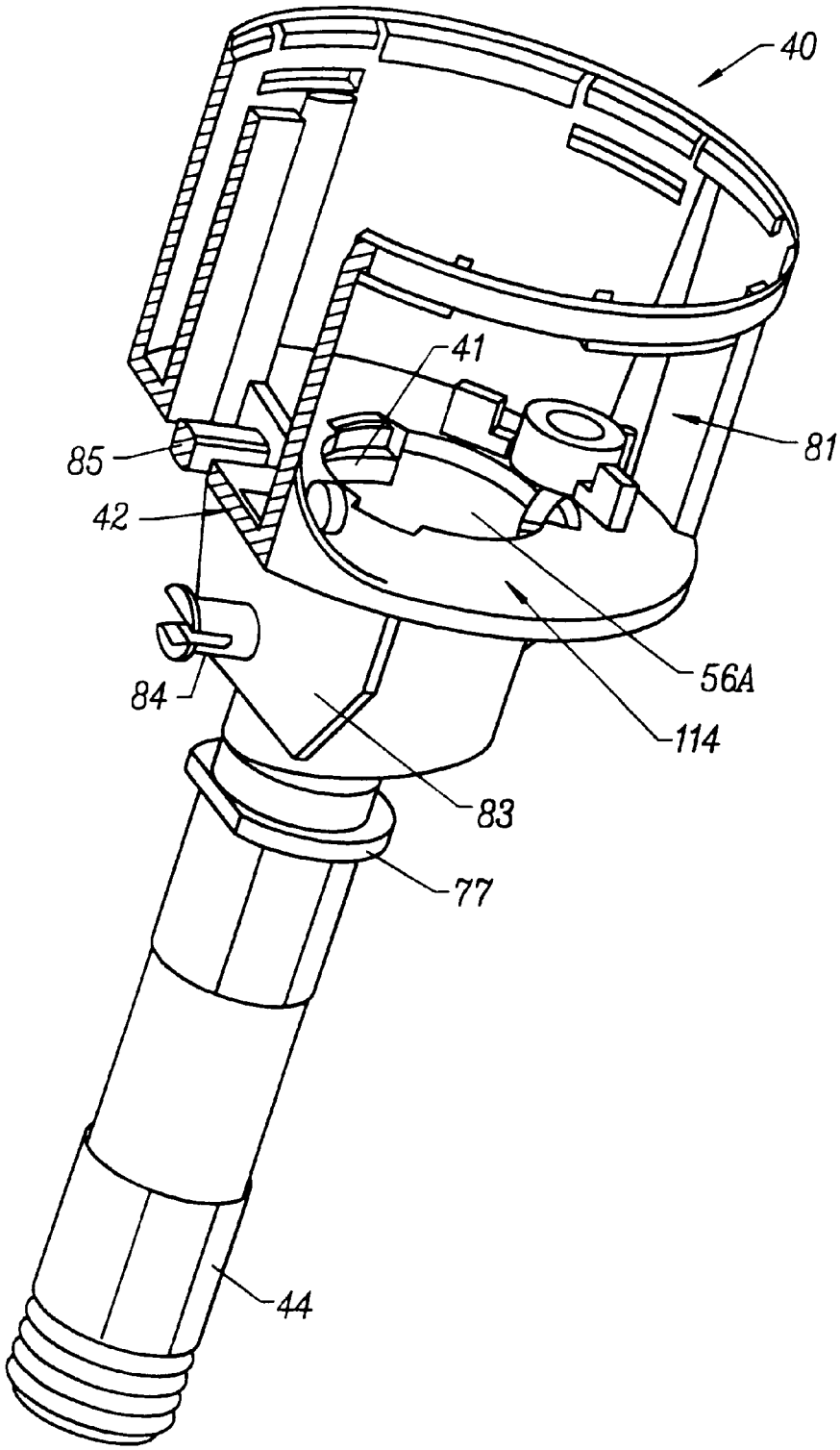

Referring now to FIG. 6A–C, there are shown perspective views of a central shaft 44 and an integrally attached turret 40. As shown in FIG. 6A, the central shaft 44 may include a through bore or conduit 56 for carrying fluids from the inlet of the sprinkler unit towards the outlet nozzle. The shaft 44 may be generally cylindrical with a reduced central portion 44A at approximately the midpoint thereof The relatively smaller diameter for this reduced portion 44A may reduce the friction between the shaft 44 and surrounding inner housing 20. A shoulder 77 may be also provided along a portion of the shaft 44 relatively upward with respect to the reduced central portion 44A. The shoulder 77 may be supported by a load bearing as described above. The central shaft 44 may further include an offset channel or vane housing 58 that is generally cylindrical but includes a tapered lower extremity and, consequently, a somewhat oblong or oval shape at the other end thereof The upper end of the vane housing 58 may be joined or integrally connected to the relatively lower or bottom portion of the turret 40. One or more openings 41 may be formed along the bottom portion of the turret housing 40 to receive and engage locking tabs formed along the outer surface of internally mounted nozzle assembly. The turret 40 may also include a trip dog opening or window 42 that receives a portion of a trip dog reversing mechanism. In addition, the turret 40 may be formed with a substantially cylindrical configuration having a central axis or midpoint that is axially aligned with the center line of the conduit 56 and an inlet for the sprinkler unit. A relatively large shield opening 81 may be also formed along the surface of the turret 40 that comprises approximately 30% of its outer surface area. The shield opening may be arranged to receive a shield portion of an adjoining impact arm for the sprinkler unit. Additionally, a relatively smaller nozzle aperture 82 may be formed along the outer surface of the turret 40, and may be aligned with the center line of the vane housing 58. The nozzle aperture or opening 82 may be aligned with a nozzle so that fluid passing through central shaft 44 may exit the nozzle and pass through the nozzle opening. A small aperture 88 may be further provided along the relatively upper surface of the turret 40 that is adapted to receive a threaded spray adjusting device which may typically take the form of a set-screw with a needle-like end.

Referring now to FIG. 6B, there is shown another perspective view of the inner shaft 44 and the turret 40 attached thereto. This view is slightly rotated relative to illustration of FIG. 6A in order to illustrate an interior portion of the turret 40 and certain components configured for a trip dog reversing mechanism. As previously described, the central shaft 44 may include a through bore or conduit 56 for carrying fluids from the inlet of the sprinkler unit and eventually out of the unit through a nozzle opening 82. The shaft 44 may include the generally cylindrical vane housing 58 with a tapered lower extremity for receiving fluid directing vanes. The relatively upper end of the vane housing 58 may be joined to the bottom portion of the turret 40. Moreover, a trip dog opening 42 is similarly depicted that receives a portion of. the trip dog. A skirt 83 may be formed adjacent to the vane housing 58. The turret housing 40 and the skirt 83 may be integrally formed if so desired. Additionally, a trip actuator pivot pin 84, shown as a split pin, may be formed along the surface of the skirt 83 to support a trip actuator as part of the direction reversing mechanism for the sprinkler unit. Similarly, a trip dog pivot pin 85, for supporting a trip dog, may be provided along the bottom surface of the turret 40 in proximity to the skirt 83.

FIG. 6C provides a partial cut-away section of the turret 40 and the central shaft 44 similarly shown in FIGS. 6A–B. The plurality of openings 41 formed along the bottom portion of the turret housing 40 may receive and engage locking tabs on the outer surface of a nozzle assembly (not shown) that is positioned within an assembly cavity 56A. The turret 40 also includes the trip dog opening or window 42 that receives a portion of a trip dog reversing mechanism. The relatively large shield opening 81 formed along the surface of the turret 40 receives the shield portion of an adjoining impact arm. The split trip actuator pivot pin 84 may be formed along the surface of the skirt 83, and the trip dog pivot pin 85 may be also provided along the bottom surface of the turret 40. Additionally, an inner surface 114 within the turret housing 40 may be opened, angled and channeled to further wipe and flush out to harmlessly any debris or particulate that may bypass a wiper seal lip or protective shield covering the shield opening 81. The flushed surface 114 eliminates or minimizes the accumulation of debris that may be trapped within the sprinkler unit as with prior art designs.

A closed-case impact sprinkler unit may be thus provided that includes a riser sleeve formed with a top end portion slidably positioned within the interior region of an outer case that is upwardly extendable from the outer case into a pop-up position. The riser sleeve may be formed with an external surface that is complimentary to the internal surface of the outer case to prevent the introduction of debris into the interior region of the outer case when the riser sleeve is in a pop-up position. Furthermore, the unit may include a closed-case turret assembly as described above that is rotatably positioned on the top end portion of the riser sleeve. The turret assembly may include a fluid outlet passageway in communication with the fluid inlet, and a hinged impact arm mounted within the turret assembly that interacts with water ejected from the fluid outlet passageway. The hinged impact arm may be extendable beyond the external surface of the turret assembly into an open position when impacted by a fluid that ejected from the fluid outlet passageway. The riser sleeve and the closed-case turret assembly may be formed with external surfaces that provide a generally cylindrical shape that is complimentary to the inner surface of the outer case and formed with a generally cylindrical shape. The unit may also include means for selectively permitting the flow of fluid into the fluid outlet passageway to extend the impact arm into an open position only when the riser sleeve is placed in a pop-up position.

Figure 7:
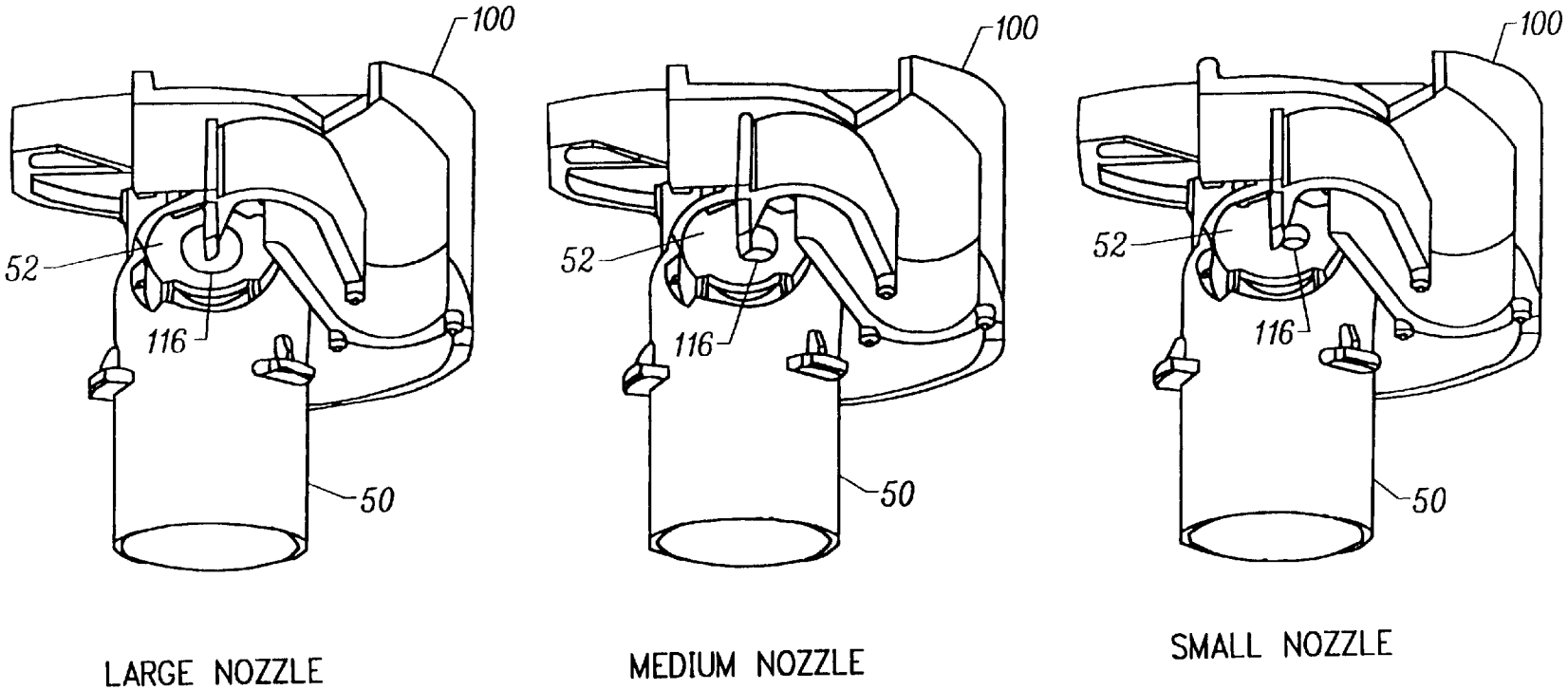
FIG. 7 shows various sized nozzle assemblies that may be used with the closed-case impact sprinklers provided herein.

FIG. 7 illustrates a variety of nozzle housing and impact arm assemblies that may include small, medium and large sized nozzle passageways. A nozzle 52 may be attached to a nozzle support assembly or housing 50 with any suitable means, preferably by a bayonet type attachment to provide angular alignment of the nozzle to an impact arm 100. The position of a nozzle passageway 116 may vary according to the selected nozzle size and may be positioned slightly off center with respect to the nozzle 52. An offset nozzle passageway 116 may direct the nozzle stream into a serpentine passage along the impact arm 100 to a lesser degree in high gallonage, large nozzles, and to a greater degree in low gallonage, small nozzles, thereby controlling the reaction force imparted on the arm by the nozzle stream. This controlled reaction force generally provides a more uniform rotation speed in sprinklers of differing nozzle sizes for more precise sprinkler distance of throw and application rate. The flow-management arrangement for the sprinkler unit embodiments of the invention described herein selectively provide the flow of water through a selective nozzle for any desired flow control purpose.

Figure 8B:
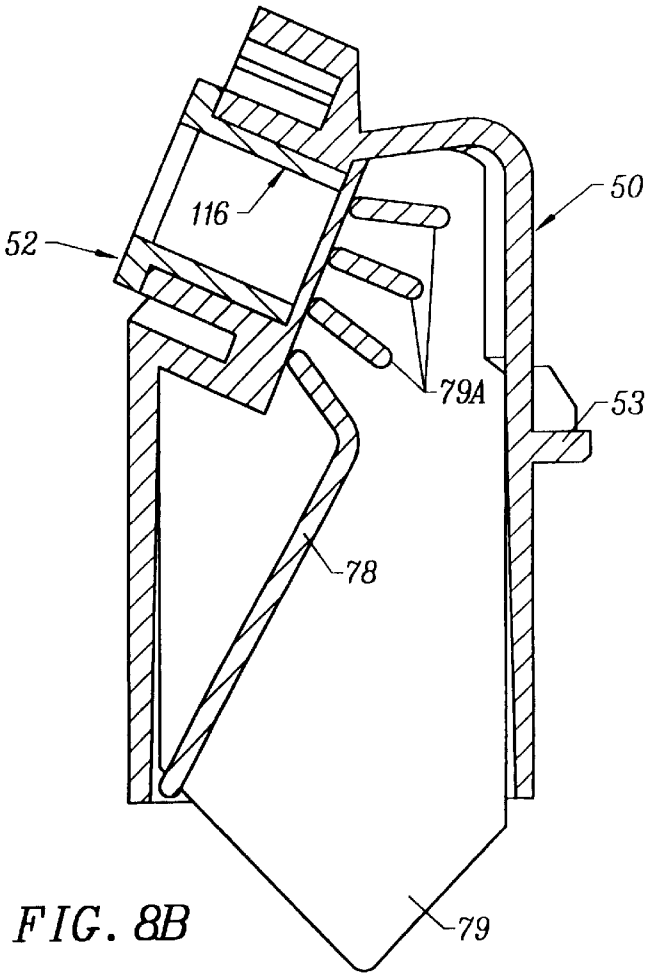
FIGS. 8A–B are enlarged front elevation and cross-sectional views, respectively, of a nozzle housing assembly similarly shown in FIG. 7.
Figure 8A:
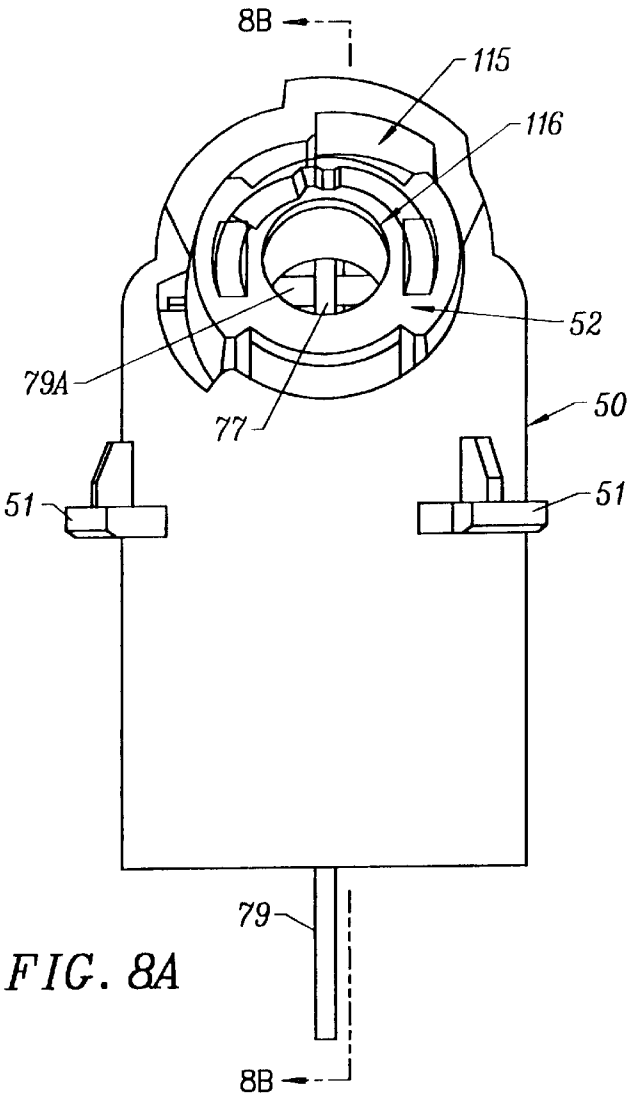

Referring now to FIG. 8A, there is shown a front elevation view of a nozzle support assembly. A nozzle support 50 may be formed with a generally cylindrical configuration, and may include a plurality of side tabs 51 that are adapted to engage corresponding openings formed along the lower surface of a turret housing as described herein. A slot 115 may be formed along the nozzle housing 50 to receive bayonet tabs located on the outer surface of a mounted nozzle 52. Referring now to FIG. 8B, there is shown a cross-sectional view of the sprinkler attachment shown in FIG. 8A taken along the lines A—A. A lip 53 may be formed at the relatively rearward portion of the nozzle head support 50 similar to the tabs 51 so as to interact with openings formed in the lower surface of the turret. Referring concurrently to FIGS. 8A–B, there is shown a central vane 79 which extends below the lower end of the nozzle support or housing 50 that substantially conforms to the configuration of the angled end or offset portion of a central shaft or tube extending below the turret. The vane 79 may include a forward wall or surface 78, as shown in FIG. 8B, adapted to co-act with the inner surface of the nozzle housing 50 to form a channel which forces water or other fluid into the nozzle 52. The wall 78 may be angled to create a directional path for the water flowing from the central shaft or tube and out of the nozzle 52. Additionally, plurality of lateral vanes 79A (three of which are shown in this embodiment) may be also formed on the upper end of the vane 79 so as to interact with the wall 78 and the inner surface of nozzle housing 50 to effectively reduce turbulence through the housing and create a more uniform flow through the nozzle 52 and nozzle passageway 116.

Figure 9B:
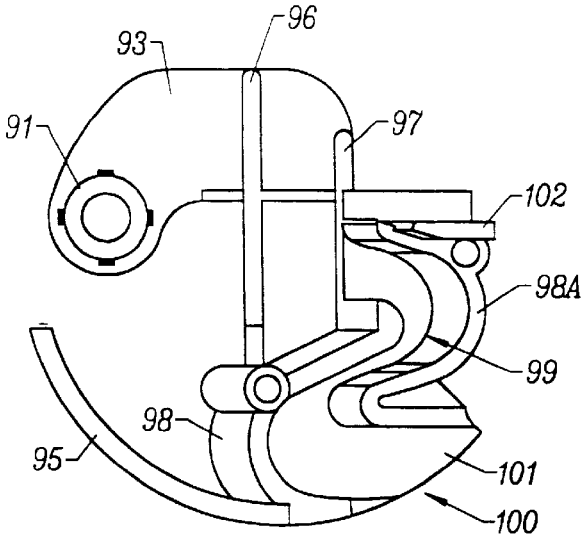
FIGS. 9A–D are enlarged views of an impact arm and turret cover similarly shown in FIG. 7.
Figure 9A:
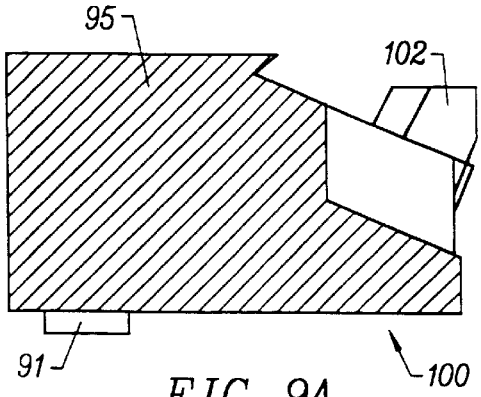
Figure 9D:
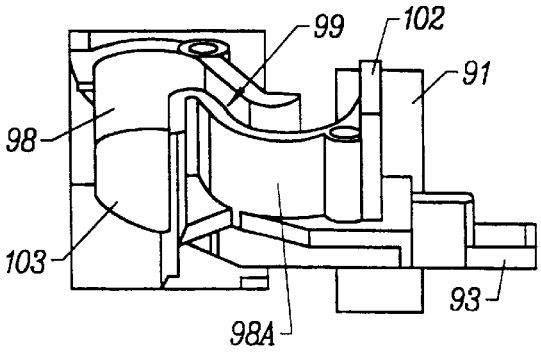
Figure 9C:
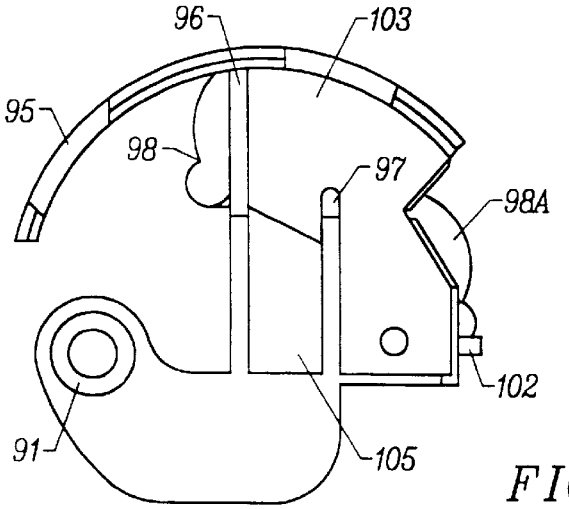

FIGS. 9A–D provide various view of a compact impact arm 100 provided in accordance with the invention. A serpentine path or flow redirection tube 99 formed in the impact arm 100 interruptively redirects water flow ejected from an adjacent nozzle to provide a counter-rotating moment to the sprinkler arm relative to a turret. Additionally, the serpentine path 99 may provide a time delay to the counter-rotating moment which allows the impact arm 100 to re-enter the water stream path of the nozzle and to impact the turret to provide a force to intermittently rotate the turret relative to an inner housing of the sprinkler unit. The impact arm 100 may further include a shield 95 that closes a shield opening formed in the turret to prevent debris from entering the sprinkler unit and its upper housing area such as when the turret passes a wiper seal lip near a debris contaminated region at the soil surface. When the water stream from the nozzle strikes the serpentine path 99, the impact arm 100 rotates around an offset fulcrum pin positioned within a pin sleeve bearing 91 formed in the impact head. By using the offset fulcrum, the sprinkler unit may include a relatively long impact arm and a smaller overall diameter in comparison to conventional impact sprinklers with a center mounted impact arm. Referring now to FIG. 9A, there is shown one elevation view of the impact arm 100. In this view, the shield 95 is shown adjacent to the fulcrum sleeve bearing 91. As will be seen, the sleeve bearing 91 and the shield 95 may be integral portions of the impact arm 100. The impact arm 100 and sleeve bearing 91 may rotate around a fulcrum pin. Furthermore, the shield 95 may be adapted to effectively close the shield opening in the turret when the sprinkler unit is not operative. The shield 95 is effective in excluding sand, grass and other debris from entering the turret. A directional tab 102 may extend outwardly from the arm 100 to selectively interact with a trip dog directional mechanism. Referring now to FIG. 9B, there is shown a partially broken away, interior bottom plan view of the impact arm 100 when viewed relatively upwardly from the inlet end of the unit. The fulcrum sleeve 91 may be a hollow cylinder mounted about the fulcrum pin. The sleeve 91 may be joined to a support arm 93 which is connected to the impact shield 95 by connecting struts 96 and 97, as well as arcuate walls 98 and 98A. The serpentine path 99 may be defined by this series of walls together with an upper surface 101 and a lower surface, which may be referred to as a porting or exhaust tube, to perform the functions previously described. Referring to FIG. 9C, there is shown a top plan view of the impact arm 100. The support arm 93 may be joined to the sleeve 91 as well as the struts 96 and 97 as shown in FIG. 9B. A bottom surface 103 of the serpentine path 99 may be integrally formed with the struts 96 and 97. A central opening 105 may be formed to reduce the wall section of the impact arm for molding as well as to reduce the cost of materials and the like. Referring to FIG. 9D, there is shown a partially broken away, elevation view of the impact arm 100 rotated by 90° around the centerline thereof relative to FIG. 9A. In FIG. 9D, the serpentine tube 99 is shown as defined by the serpentine walls 98 and 98A together with the lower surface 103. The upper surface 101 however is omitted in this view, and the sleeve 91 is depicted as joined to the support arm 93. It should be noted that the ends of both serpentine wall 98 and 98A may be tapered into or shaped into a fairly sharp edge in order to properly interact with the water stream from the nozzle.

Figure 10A:
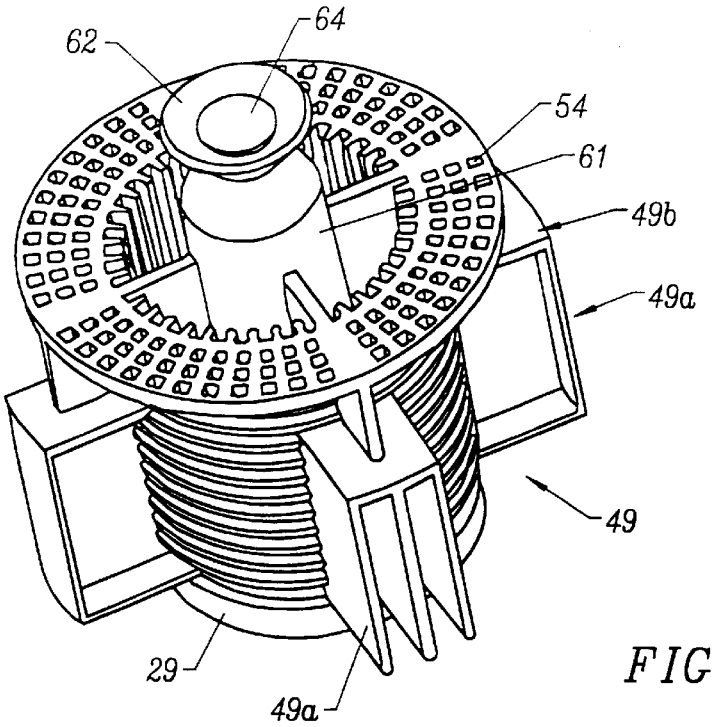
FIGS. 10A–B are perspective views of a filter used in accordance with the closed-case impact sprinkler units described herein.
Figure 10B:
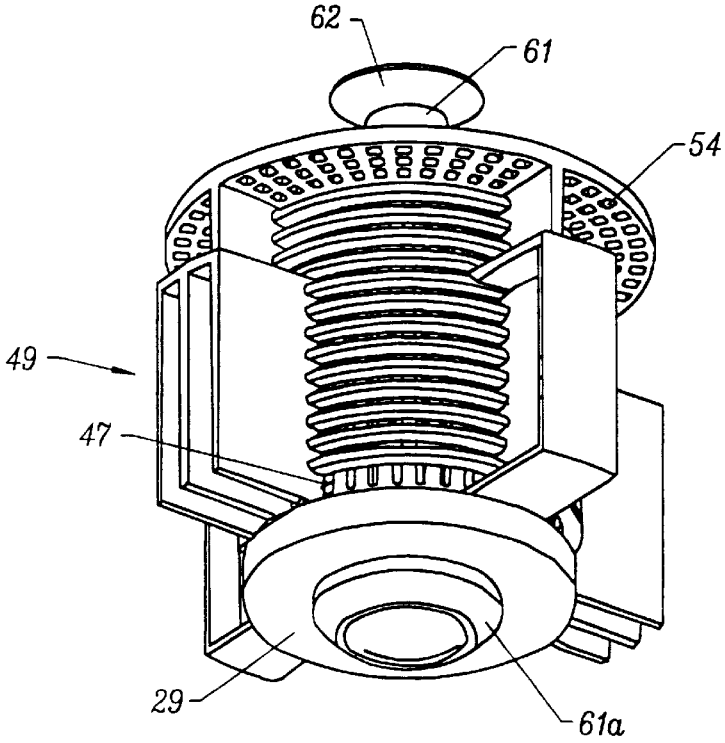

Referring now to FIGS. 10A–B, there are shown perspective views of a filter 49 for sprinkler units described herein. The filter 49 may be typically formed as a porous, basket-like component with a plurality of side openings 47 formed along its outer surface, and upper openings 54 along its upper planar surface 49B. The side openings 47 and upper openings 54 in the filter may be large enough to readily pass water or the like therethrough while filtering out most particulate matter. This action minimizes or prevents clogging of a sprinkler unit nozzle. The filter 49 may be readily cleaned, when necessary, by merely removing the inner housing from the outer housing of a unit thus exposing the filter. Additionally, a valve stem 61 may be attached to the filter 49. A reverse flow valve seat 62 may be also attached to the upper end of the valve stem 61 by a seal retainer 64. The valve seat 62, which may be conically shaped, and the valve stem 64 may interact with an inlet cap attached to a central shaft within the inner housing of the unit. A check valve gasket 29 may be secured to the lower end of the valve stem 61 by extensions or fingers 61A. The top surface 49B of the filter 49 may contact a limit stopping surface just prior to the inner housing reaching the top of its stroke. Following contact, the valve seat 62 may be forced away from the inlet nut or cap thus opening the valve assembly. While the filter 49 is being forced away from the inlet nut, it may be continuously guided by its sides 49A acting on guide surfaces formed along the inner housing.

Figure 10C:
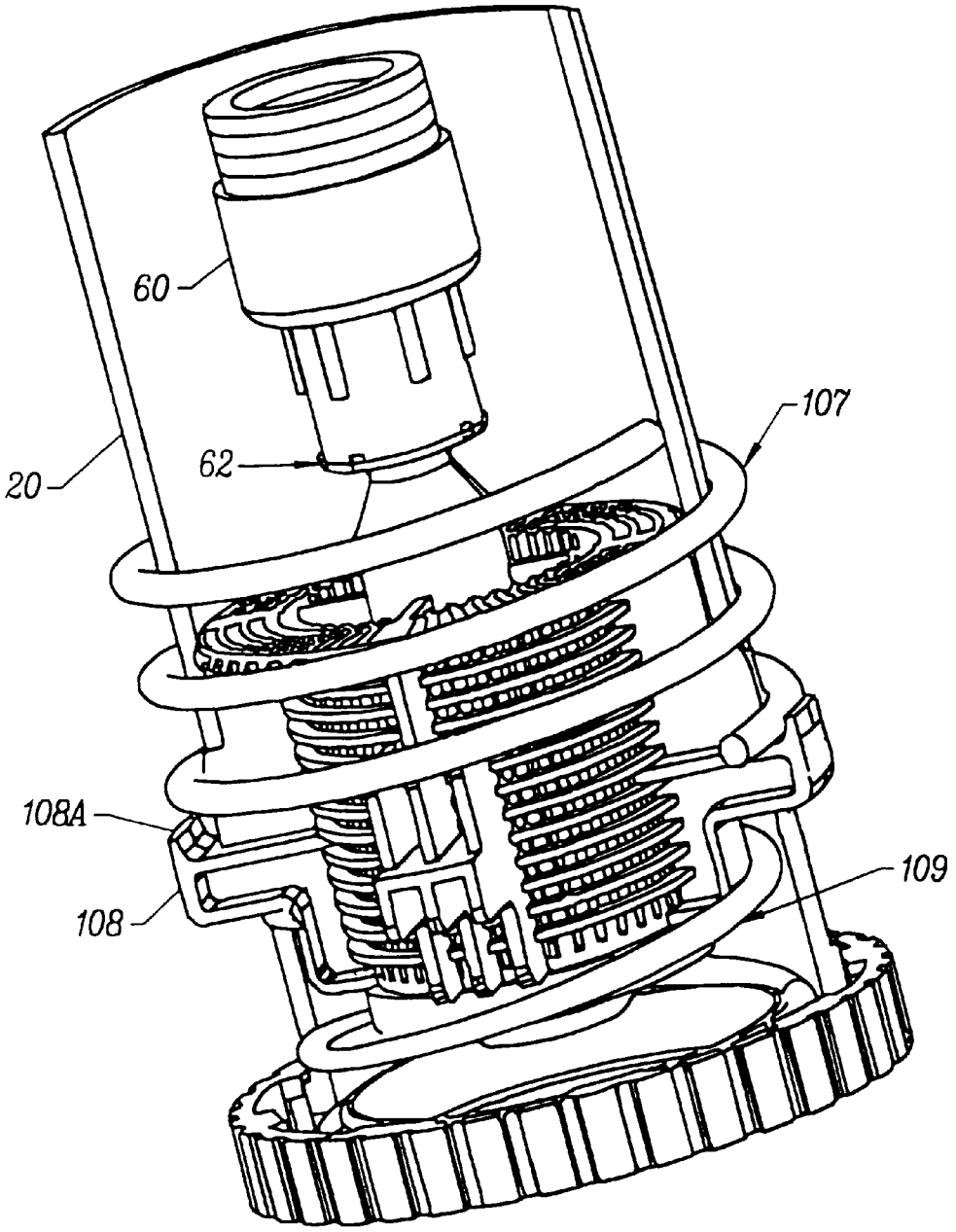
FIG. 10C is a perspective view of the bottom end portion of a closed-case sprinkler formed in accordance with another aspect of the invention that includes a filter positioned between a primary and a secondary riser spring.

In another embodiment of the invention, as shown in FIG. 10C, the filter 49 may be positioned between multiple riser springs 107 and 109. A primary riser spring 107 and a secondary riser spring 109 may be selected for the sprinkler units provided herein to control the opening of the valve assembly and the relative movement of the inner housing 20 within the outer housing. The primary riser or retract spring 107 may be positioned in between a spring retainer near the top portion of the outer housing and a plurality of spring arms 108 formed along the sides of the filter 49. The spring arms 108 may slidably fit within a series of slots or cut-outs formed along the lower portion of the riser sleeve 20 to permit relatively upward and downward movement within a preselected range. A retaining lip 108A may be formed along the edges of the spring arms 108 to assist in retaining the primary riser spring 107 which is slidably fitted around the external surface of the riser sleeve 20. The secondary spring 109 may be also retained in between the spring arm 108, which may be integrally formed with the filter 49, and a removable disk-shaped end cap or nut 60 that may be attached to the lower end of the inner housing or riser sleeve 20 with a twist-lock fit. As water enters the sprinkler unit causing the inner housing or sleeve 20 to rise, the primary riser spring 107 begins to compress and move towards a more solid-type configuration. Meanwhile, the secondary riser spring 109 or valve shut-offspring operates to temporarily prevent water from entering through the inlet cap 60 providing a positive seal so the sleeve 20 is permitted to rise while delaying extension of the impact arm. At least initially, the secondary spring force is greater than the primary spring force. However, as the primary spring 107 contracts and begins to exert a greater force against the secondary spring 109, the secondary spring begins to compress. The valve seat 62 therefore moves away from the inlet nut or cap 60 thus opening the valve assembly. The relatively upward force applied by the secondary spring 109 is initially greater than the relatively downward force applied by the primary spring 107 when the inner sleeve 20 is rising. As the primary retracting spring 107 goes solid, it exerts a greater downward force that pushes against the filter 49 to open the valve assembly. The time-delay caused by the opposing forces of the multi-spring configuration described herein permit the two-stage activation of the sprinkler units provided herein. It is understood that the appropriate selection of riser spring combinations may be readily determined based upon known characteristics for the springs including their spring constants, selected lengths and their composition.

A dual-stage sprinkler head may be thus provided in accordance with the invention that basically comprises an outer sleeve, an inner sleeve and a riser spring assembly. The outer sleeve may be formed with an interior chamber and a fluid inlet for receiving a supply of water. The inner sleeve may be formed with a fluid outlet, and may be slidably positioned in the interior chamber of the outer sleeve. In addition, the inner sleeve may include a slidably connected spring retainer that is connected to a valve assembly. The valve assembly may selectively permit the passage of a fluid from the fluid inlet to the fluid outlet when moved relatively downward with respect to the inner sleeve. In addition, the valve assembly includes a water filter having a valve seat. The interior portion of the inner sleeve may include a central shaft with a end section that is configured to engage the valve seat as fluid enters the interior chamber of the sleeve, and to disengage the valve seat as the spring retainer moves relatively downward with respect to the inner sleeve. The water filter may include the spring retainer for retaining an end portion of the first spring and an end portion of the second spring. At the same time, the lower end portion of the inner sleeve may include a spring retainer for retaining an end portion of the first spring, and the upper end portion of the outer sleeve may include a spring retainer for retaining an end portion of the second spring. Furthermore, the riser spring assembly include a first spring positioned between the spring retainer and a lower end portion of the inner sleeve, and a second spring positioned between the spring retainer and an upper end portion of the outer sleeve. The first spring may be compressed during a first stage as the inner sleeve rises when fluid enters from the fluid inlet into the interior chamber of the outer sleeve, and the second spring may be compressed during a second stage as the first spring moves towards a compressed state to move the spring retainer relatively downward with respect to the inner sleeve to permit the passage of fluid through the sprinkler unit. Additionally, a turret may be rotatably mounted the top portion of the inner sleeve as described herein. An impact arm may be rotatably mounted to the turret with a hinge pin to selectively extend to an open position only during the second stage when the valve assembly permits the passage of fluid to the fluid outlet. The length of the impact arm may be maximized by mounting it with an off-centered hinge pin as opposed to a centrally mounted pin which would provide a reduced water throwing range for the sprinkler head. Furthermore, a nozzle may be positioned within the turret that is connected to the fluid outlet. The nozzle may be formed with an interior region that includes a fluid vane to direct fluid flow out of the nozzle. The fluid vane may include a plurality of fluid-directing surfaces to direct the flow of fluid ejected from the nozzle.

Figure 10E:
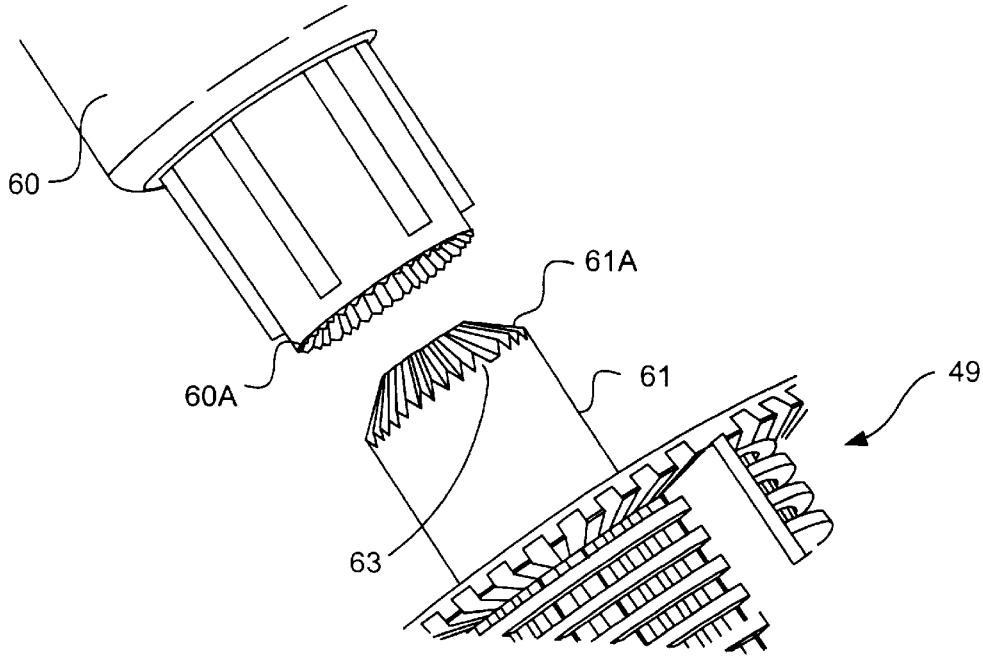
FIGS. 10D–E are perspective views of a fitted seal formed between contacting serrated surfaces of an inlet cap and a filter included within the sprinkler units provided herein.
Figure 10D:
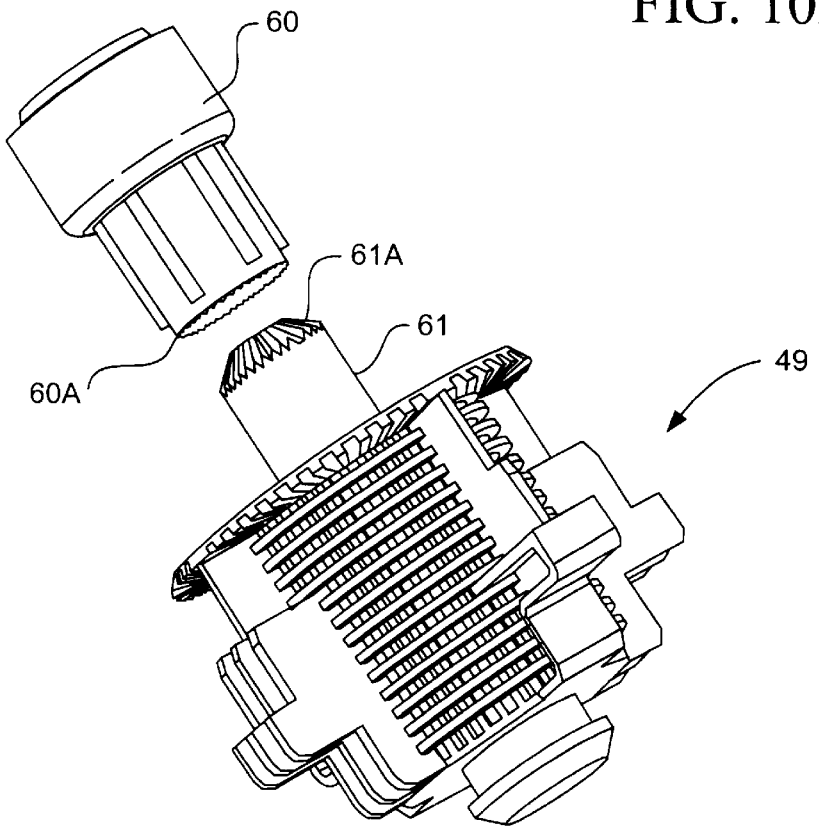

FIGS. 10D–E illustrate a fitted seal formed between contacting surfaces of an inlet cap 60 and a filter 49 included within the sprinkler units provided herein. In a preferable embodiment of the invention, a sprinkler head (not shown) is provided with a fitted serrated fluid seal assembly. The head may include an outer case having an interior region, and a pop-up sprinkler head turret mounted on a riser sleeve slidably mounted within the interior region of the outer case. The turret may be formed with an elongated central shaft for the passage of water. Additionally, a water filter 49 within the riser sleeve may include a valve stem 61 for communication with a lower end portion of the central shaft which may include an inlet nut 60. The communicating surfaces of the lower end portion of the central shaft and the valve stem 61 of the water filter 49 are each formed with complementary serrated surfaces. Each of the serrated surfaces may be formed with a variety of matching surfaces including complementary tapered edges 60A and 61A. The serrated surface 61A of the water filter 61 may also include a plurality of serrations, wherein at least one of the serrations 63 is relatively larger that the other serrations as shown with greater particularity in FIG. 10E.

In a preferable embodiment of the invention, a pair of relatively larger serrations are positioned around a substantially circular diameter along an external surface 61A surrounding the valve stem 61 of the water filter 49. The pair of relatively larger serrations may be positioned approximately 180 degrees across from each other. These larger formations create an intended gap between the water filter 49 and the serrated inlet nut surface 60A so that water within the fluid passageway of a central shaft may properly drain. In some instances, with other valve configurations provided herein, deformable fluid seals and valve seats may be excessively deformed over an extended period of time. As a result, the valve seat may become stuck within the inlet nut interior which prevents water from properly draining out of the fluid passageway within the central shaft. This may keep the sprinkler unit in an unintended pop-up position. With proper drainage, water may thus bleed-out by selecting a larger serration or by removing or eliminating a serration to provide the desired drainage gap.

The serrated seal configuration illustrated in FIGS. 10D–E further prevent the relative movement of the central shaft and connected turret assembly when the sprinkler unit is in a retracted position. The serrations form a lock-type fit or keyed arrangement that prevents the turret and/or the adjustable collar from unintended adjustment or acts of vandalism when the unit is not in a pop-up position. This serrated fluid seal configuration provides a wet-type of adjustment wherein the sprinkling range can be readily altered when the unit is operational. A dry-type of adjustment may be also provided when the unit is non-operational. When the flow of water is interrupted, the sprinkler riser assembly may be manually popped up by an operator with selected tooling such as a pull-up socket.

Figure 11:
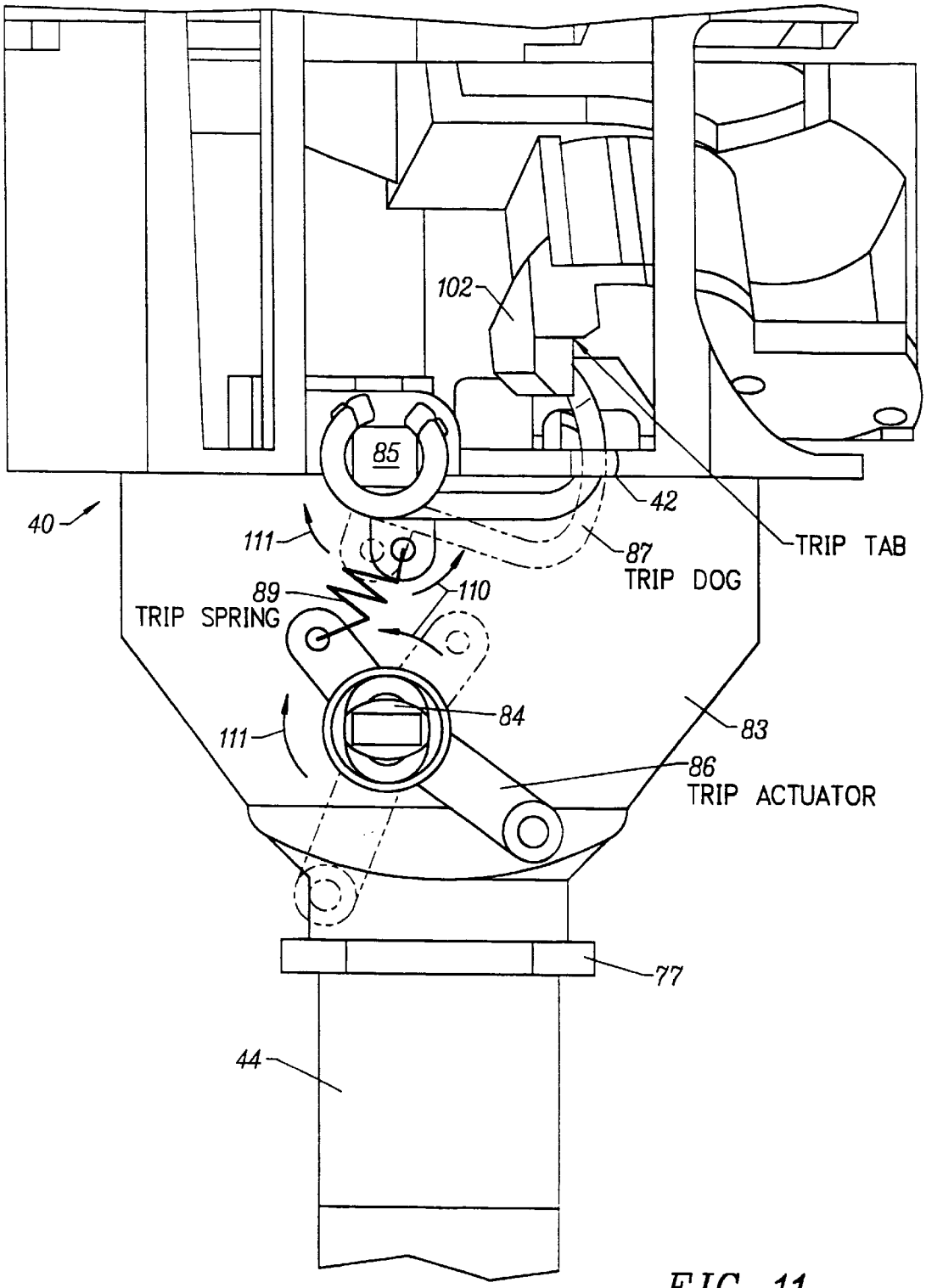
FIG. 11 is a front view of a reversing or trip mechanism shown in the forward and the reverse positions with respect to a turret housing portion.

Referring now to FIG. 11, there is shown a partial view of a turret 40 together with a view of a reversing mechanism for the instant invention. As previously described herein, a skirt 83 may extend downwardly from the bottom of the turret 40. A trip actuator 86 may be pivotally mounted on a actuator pivot pin 84 while a trip dog 87 is pivotally mounted on a trip dog pivot pin 85. The pivot pins may be formed on or integral with the skirt 83. A spring 89 such as a torsion spring may be connected between adjacent ends of the trip actuator 86 and the trip dog 87. In operation, the trip dog 87 and actuator 86 may assume two different stable positions as shown by the solid line (position 1) and the dashed line (position 2). In position 1, the trips 86 and 87 are shown in a "sprinkler reverse" condition. The trip mechanism has just finished rotating in the counter clockwise direction shown by the arrows 110. That is, the trip actuator 86 has been rotated counter clockwise causing the spring 89 to go "over center" which the rotates trip dog 87 counter clockwise into a "sprinkler reverse position." In position 1, the trip dog 87 captures a trip tab 102 which may be formed as part of a sprinkler arm. In position 2, the trip actuator 86 may be rotated clockwise causing the spring 89 to again go "over center" causing the trip dog 87 to rotate clockwise out of engagement with the tab 102 of the impact arm 100. In this position of the trip dog 87, the sprinkler unit is in the "forward" running condition. To move from position 1 to position 2, the trip actuator 86 may rotate about its pivot pin 84 in the clockwise direction as shown by arrows 111. This action initially causes the trip spring 89 to compress, until it goes "over center." The spring 89 then expands thereby driving the trip dog 87 to the next stable condition in position 2 as shown by the dashed line. It will be noted that the spring 89 is biased to separate the trip dog lever 87 from the trip actuator lever 86. A trip collar may act on the lower arm of the trip actuator 86 to cause the spring 89 to compress and to initiate the switching between positions 1 to 2.

Figure 12A:
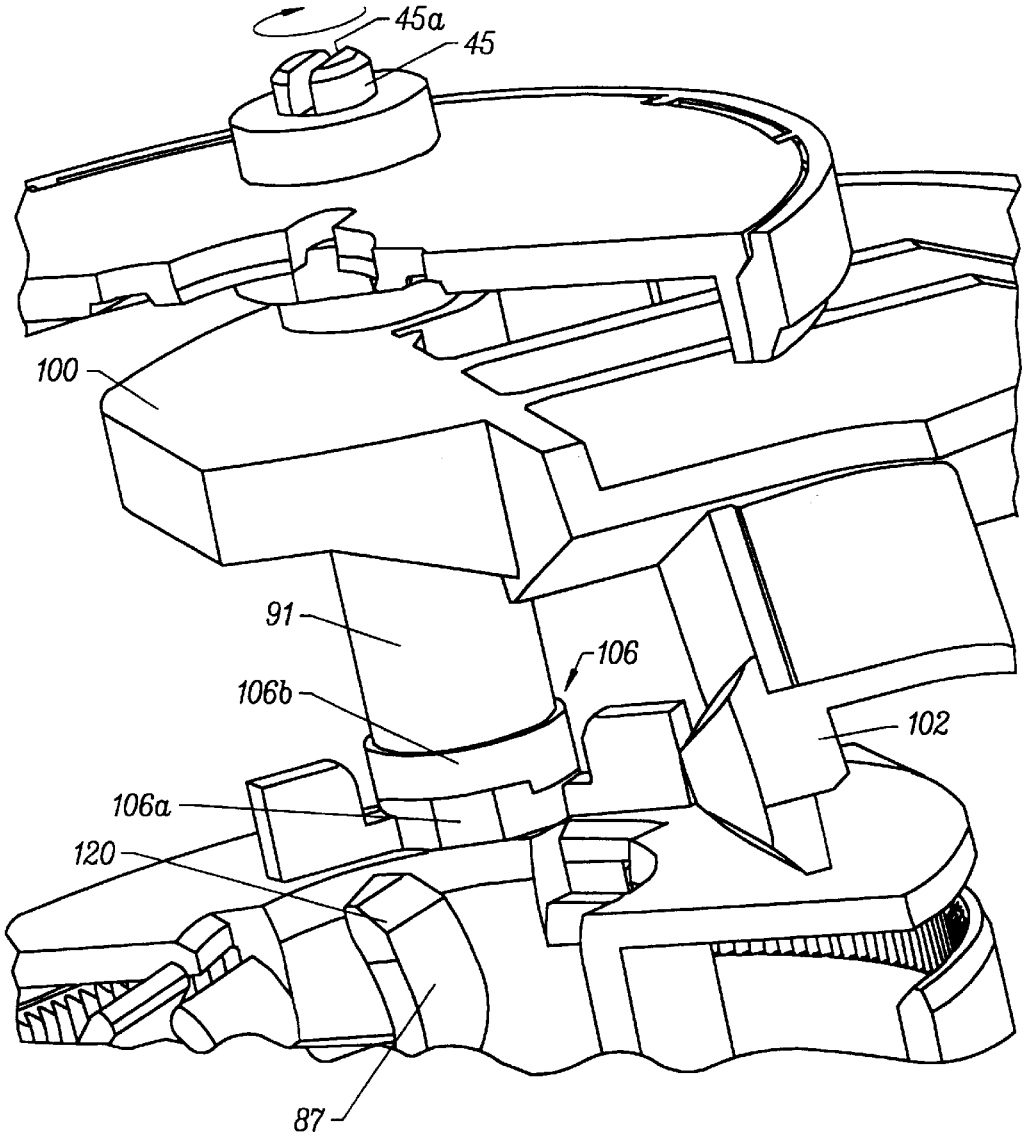
FIGS. 12A–B show enlarged perspective views a position controller for providing a variety of sprinkling patterns including partial or full-circle reversible sprinkler operation.
Figure 12B:
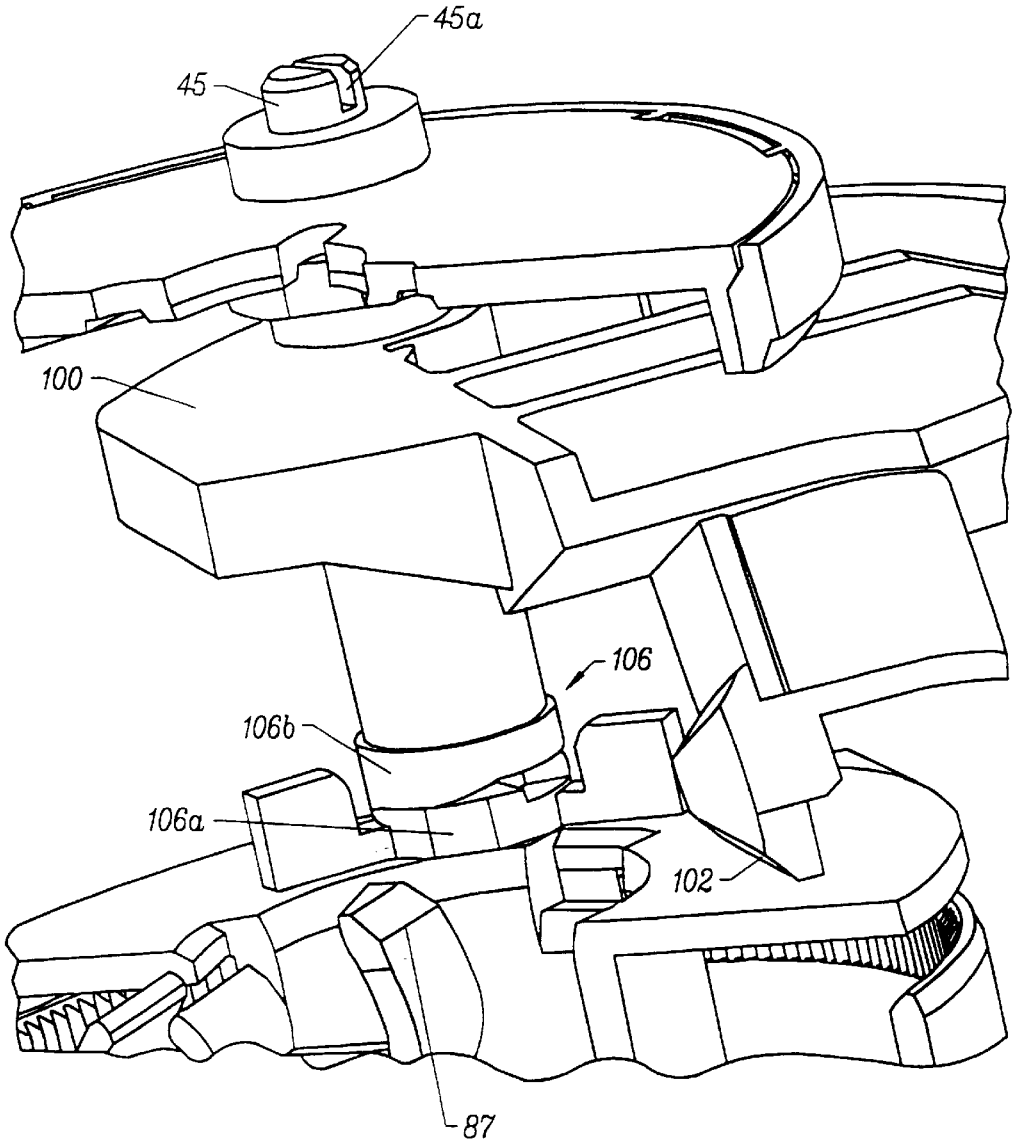
Figure 12C:
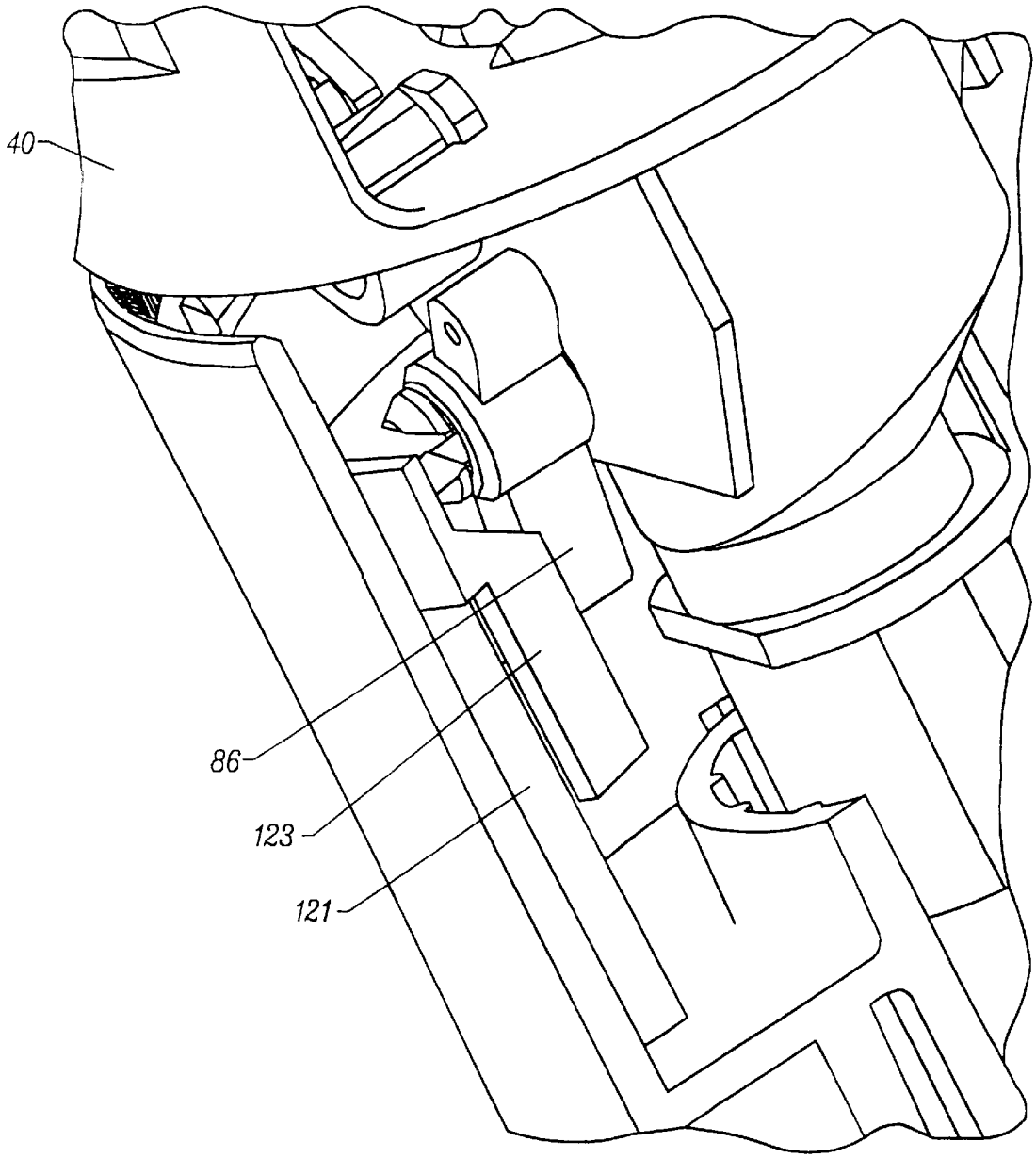
FIG. 12C shows a relatively simplified enlarged perspective view of a trip collar and actuator assembly for various embodiments of the invention.

Referring concurrently now to FIGS. 12A–C, there is shown a position controller for determining two potential operation conditions of the unit such as forward/reverse or forward only. During the forward/reverse sprinkler rotation, the directional tab 102 of an impact arm 100 may alternately contact a reversing pawl 120 on the trip dog 87 when the sprinkler is to be driven in the reverse directions. That is, an arm biasing cam 106 selectively positions the impact arm 100 in one of two axial locations above the reversing pawl 120. In position 1, the arm 100 may be allowed to changeably contact the reversing tab or pawl 120 providing a "part circle" sprinkler operating condition. In position 2, the arm 100 may be held above the reversing pawl 120 by a cam 106 such that reversing pawl can no longer contact the arm 100 effectively locking sprinkler unit in a "full only" operating condition.

Referring now to FIG. 12A, there is shown a partial view of the components of a turret 40 and, in particular, the adjustment mechanism for converting the sprinkler unit from a partial circle operation to a full circle only operation. The sprinkler may be initially set in a partial circuit configuration. Thus, the trip dog 87 extends through an aperture formed in the lower surface of the cut-away turret as shown and is effective to capture the tab 102 of the impact arm 100 during rotation of the turret. The position of tab 102 is controlled by the position or location of the impact arm 100. The cam 106 may include a cam surface 106A which is formed on an inner surface of the turret. The cam 106 may include a circular, inclined plane at its upper surface. A movable cam plate 106B may be attached to a fulcrum pin 45 and rest on the surface of the cam surface 106A. The cam plate 106B has a circular, inclined plane surface which cooperates with the inclined plane surface on the cam surface 106A. The fulcrum pin 45 may extend through the upper surface of the turret as well as the unit covering. The fulcrum pin 45 may further include a slot 45A formed in the upper end thereof for easy manipulation thereof by a screw driver or the like. The fulcrum pin 45 may be rotated counterclockwise so that the mating surfaces of the cam surface 106A and the cam plate 106B achieve the illustrated position or any other. In this case, the high points of the two cam surfaces are adjacent to each other wherein the cam has attained the least vertical dimension. In this case, the arm 100 is in the position shown wherein the tab 102 is capable of engaging the trip dog 87.

As shown in FIG. 12B, the fulcrum pin 45 may be rotated counterclockwise. This causes the fulcrum pin 45 to drive the cam plate 106B which is attached thereto in the counterclockwise direction as well. In this case, the inclined planes of the cam surface 106A and the cam plate 106B slide relative to each other wherein the high points of the respective cam components are in abutment with each other so that the cam 106 achieves the highest or greatest vertical dimension. Inasmuch as the impact arm 100 is attached to the fulcrum pin 45, which is raised when the cam operation occurs, the arm 100 is also raised. The distance the arm 100 is raised is designed to be sufficient to prevent tab 102 from engaging trip dog 87 even when the trip dog is in the upright position. Inasmuch as tab 102 cannot interact with and be restrained by the trip dog 87, the arm 100 is free to rotate 360° around the fulcrum pin 45 and to produce a full 360° circular spray pattern for the sprinkler. Of course, when the partial circle pattern is desired, the fulcrum pin 45 is merely rotated counter-clockwise to return the fulcrum pin 45, the cam 106 and the arm 100 to a position similarly shown in FIG. 12A.

As shown in FIG. 12C, while the impact arm is driven rotationally around the fulcrum pin, and the sprinkler turret housing 40 may be driven first in a clockwise direction until a trip adjustable tab 123 interacts with the leg of the trip actuator 86 thereby causing the sprinkler to "trip" and change direction. As sprinkler turret housing 40 rotates in the counterclockwise direction, the trip actuator leg 86 may contact a fixed trip tab 121 causing the sprinkler to "trip" and again rotate in a clockwise direction.

Figure 12D:
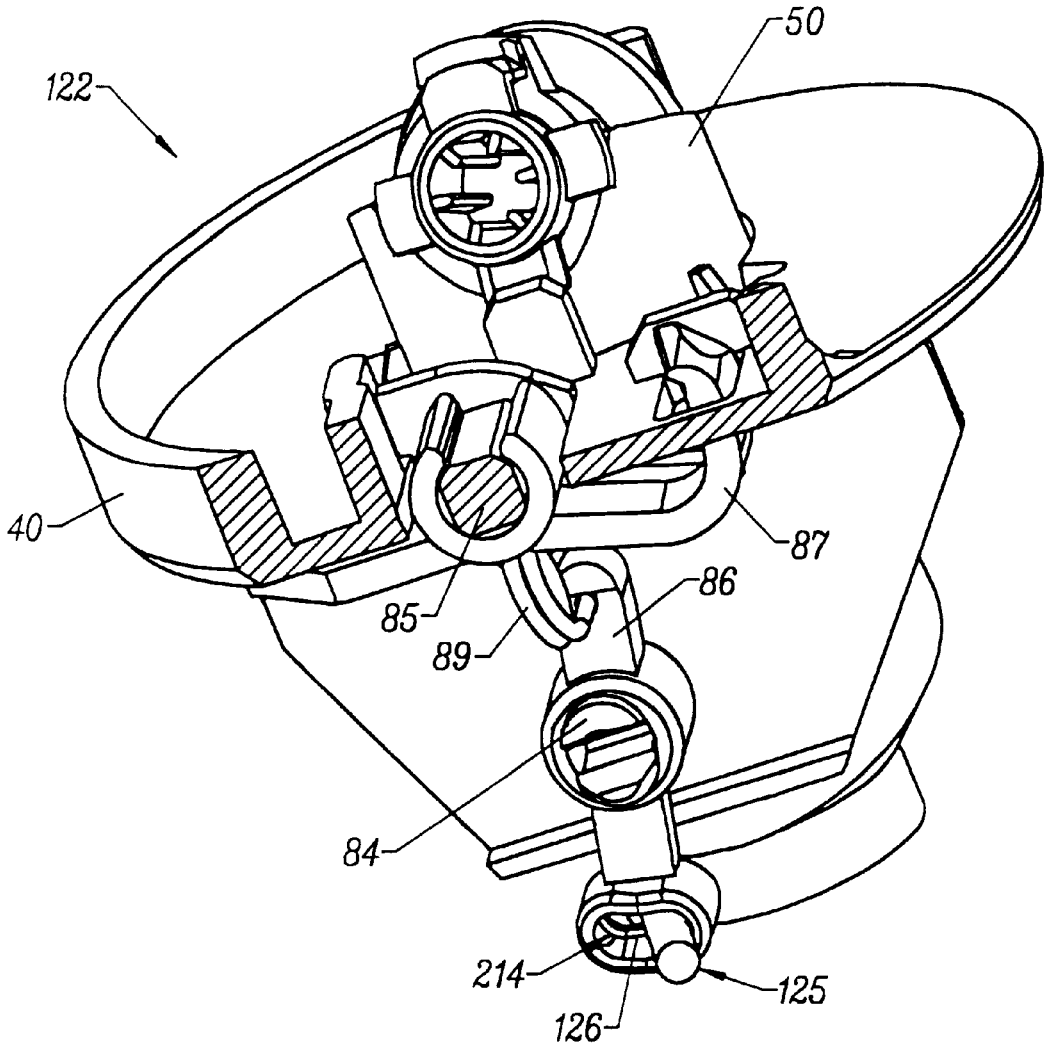
FIG. 12D shows an enlarged cut-away view of a trip actuator assembly formed in accordance with another aspect of the invention having an elongated pin opening that provides extended sprinkler rotation.

FIG. 12D is an illustration a trip actuator assembly 122 formed in accordance with another aspect of the invention. The trip actuator and dog assembly may be connected to the turret 40 as shown in relatively close proximity to a nozzle housing 50. A trip spring 87 may be selected to connect the trip dog 87 and the trip actuator 86 which are mounted about their respective pivot pins 85 and 84. The trip actuator 86 may include a trip pin or leg 125 pivotally mounted within an elongated trip actuator opening 124. The pin 125 may be connected to the trip actuator opening 124 in a ball and socket joint relationship. The interior surface of the actuator opening 124 may include a raised surface 126 that interacts with a complementary shaped surface formed along the external surface of the pin 125. As a result, the pin 125 may pivotally move in a relatively lateral direction along the width of the opening 124. The added lateral or wiggle movement provided by the elongated or widened configuration of the trip actuator slot 124 provides extended sprinkler rotation. When the trip pin 125 contacts a trip tab to reverse sprinkling rotation, the reversal mechanism is not immediately activated. Watering and rotation in the same direction continues for an additional period of time provided by the movable trip pin 125. After the turret 40 rotates a few additional degrees or more during this period of lost motion, the trip pin 125 finally reaches the side edge of the actuator opening 124 which reverses the trip actuator to its other position. The additional freedom of movement provided to the trip pin 125 as described herein provides an extended or full 360 degree watering range.

Figure 12E:
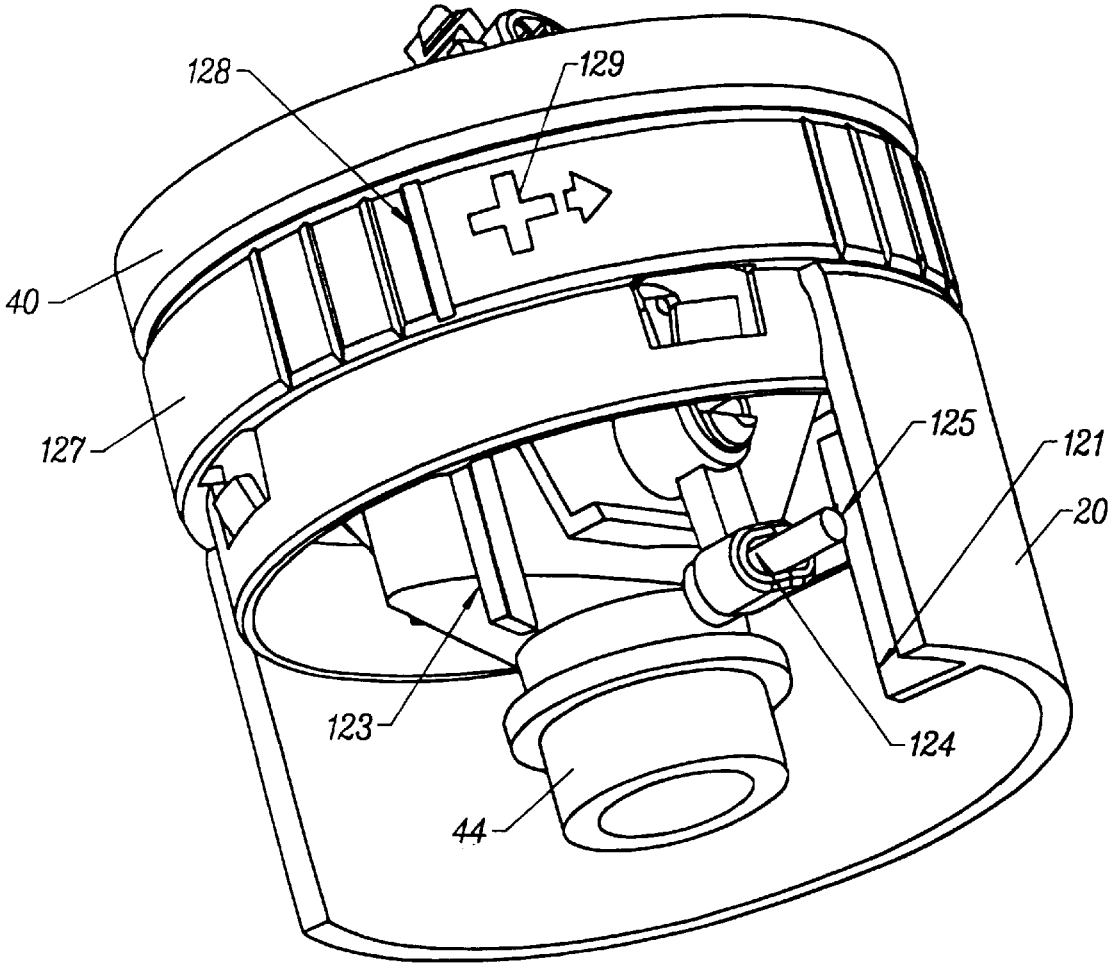
FIG. 12E illustrates a cut-away view of a trip actuator assembly similarly shown in FIG. 12D positioned within a trip collar.

Another aspect of the invention described in FIG. 12E is directed to an adjustable collar 127 for directing the sprinkling range. As shown in the cutaway section of the inner housing 20 and central shaft 44, the underside of the turret 40 is revealed to illustrate the trip mechanism for the sprinkler unit that reverses direction of the rotating turret. The upper portion of the inner housing 20 may include a relatively fixed trip or ledge 121 that extends into its interior portion. The fixed trip 121 may be configured to contact a trip pin 125 loosely connected within the trip actuator opening 124 as described herein. This lost motion trip pin 125 may move between the fixed trip 121 and an adjustable trip or ledge 123 formed with the rotatable trip collar 127. The trip collar or ring 127 may be rotatably mounted between the inner sleeve 20 and turret section, and may be set for a particular sprinkling pattern. The desired sprinkling pattern may generally correspond to a displayed identification scheme set forth on the external surface of the trip collar 127 and inner housing 20. The identification scheme may include a variety of visible markers on the collar so that an operator may set a sprinkling pattern ranging from 0 to 360 degrees or any multiple thereof such as every 90, 180 or 270 degrees. A number of dashes or marks 128 may also denote a pattern divided in intervals of 90 degrees. For example, a setting for a single mark 128 may provide 90 degrees while a setting four marks may provide a 360 degrees pattern. A reference mark to line-up with a desired setting may be of course formed on the external surface of inner housing or riser sleeve 20. The trip collar 127 may further include "+"

or "–" symbol 129 with an arrow to denote an increase or decrease in the spraying pattern respectively if rotated in the indicated direction. When a desired 360 degree spraying pattern is desired, the trip collar 127 may be rotated to increase the setting so the adjustable trip 123 is placed immediately adjacent to the fixed trip 121. The identification scheme may have a corresponding setting of four marks 128 that are lined up with the reference mark. As a result, the trip pin 125 travels substantially in a full circle with the turret 40 before the trip pin contacts a fixed 121 or an adjustable 123 trip. The degree of added lateral movement of the trip pin 125 may account for the otherwise lost rotation of the trip pin and turret 40 caused by the combined thickness of the trip pins 121 and 123. Because the trip pin 125 is pivotally and slidably mounted within the trip actuator opening 124, the turret 40 may continue rotating in an original direction for an additional few degrees before tripping the reversing mechanism and thereafter rotating in an opposite direction. This added range of free movement is provided by the wiggle room or play that results from the pivotally mounted trip pin 125. A fuller sprinkling range of 360 degrees may be thus achieved. It shall be understood that any desired sprinkling range may be set for the sprinkler units provided herein by adjusting the trip collar accordingly. An impact sprinkler head with extended sprinkling range may be therefore provided in accordance with the invention having a trip collar formed with an adjustable trip that is rotatably mounted to the top end of an outer sleeve. The sprinkler head may include a impact sprinkler head and turret assembly rotatably connected to the trip collar having a trip assembly for reversing direction of the impact sprinkler head and turret assembly. The trip assembly may include an elongated actuator opening and a trip pin pivotally mounted within the actuator opening to provide lateral movement of the trip pin within the actuator opening to initiate a delayed reversal of the trip assembly upon contact with a fixed or adjustable trip to provide an extended sprinkling range.

While the present invention has been described with reference to the aforementioned applications explained in detail above, these descriptions and illustrations of the preferred embodiments and methods are not meant to be construed in a limiting sense. It shall be understood that all aspects of the present invention are not limited to the specific depictions, configurations or relative proportions set forth herein which depend upon a variety of conditions and variables. Various modifications in form and detail of the various embodiments of the disclosed invention, as well as other variations of the present invention, will be apparent to a person skilled in the art upon reference to the present disclosure. It is therefore contemplated that the appended claims shall cover any such modifications, variations or equivalents of the described embodiments as falling within the true spirit and scope of the present invention.

What is claimed is:

1. A closed-case impact sprinkler unit comprising:

an outer case having an interior region;

a riser sleeve formed with a top end portion and an internal support channel, wherein the riser sleeve is slidably positioned within the interior region of the outer case and is upwdardly extendable into a pop-up position;

a closed-case turret assembly for the passage of water that is rotatably positioned on the top end portion of the riser sleeve which is slidably mounted within the interior region of the outer case, wherein the turret assembly includes a central shaft passing through the support channel of the riser sleeve; and a water filter within the riser sleeve having a valve stem, wherein a lower end portion of the central shaft and an upper end portion of the valve stem of the water filter comprise complimentary serrated surfaces that form a valve for passage of water into the central shaft, wherein the serrated surfaces are separable during the operation of the sprinkler head.

2. A sprinkler head with a fitted seal assembly comprising:

outer case having an interior region;

a pop-up sprinkler head turret rotatably mounted on a riser sleeve which is slidably mounted within the interior region of the outer case, and having a support channel and wherein the turret is formed with an elongated central shaft extending through the support channel for the passage of water; and a water filter within the riser sleeve having a valve stem, wherein a lower end portion of the central shaft and an upper end portion of the valve sterm of the water filter comprise complimentary serrated surfaces that form a valve for passage of water into the central shaft, wherein the serrated surfaces are separable during the operation of the sprinkler head.

3. The sprinkler head as recited in claim 2 wherein each serrated surface are formed with a complementary tapered edges.

4. The sprinkler head as recited in claim 2 wherein the serrated surface of the water filter include a plurality of serrations, and where at least one of the serrations is relatively larger that the other serrations.

* * * * *